US009745160B2

(12) United States Patent
Hongo et al.

(10) Patent No.: US 9,745,160 B2
(45) Date of Patent: Aug. 29, 2017

(54) PAPER CONVEYING APPARATUS, JAM DETECTION METHOD, AND COMPUTER PROGRAM

(71) Applicant: PFU LIMITED, Kahoku-shi, Ishikawa (JP)

(72) Inventors: Masanobu Hongo, Kahoku (JP); Takayuki Umi, Kahoku (JP); Shuichi Morikawa, Kahoku (JP)

(73) Assignee: PFU Limited, Kahoku-shi, Ishikawa (JP)

( * ) Notice: Subject to any disclaimer, the term of this patent is extended or adjusted under 35 U.S.C. 154(b) by 0 days.

(21) Appl. No.: 15/100,477

(22) PCT Filed: Dec. 26, 2013

(86) PCT No.: PCT/JP2013/084875
§ 371 (c)(1),
(2) Date: May 31, 2016

(87) PCT Pub. No.: WO2015/097814
PCT Pub. Date: Jul. 2, 2015

(65) Prior Publication Data

US 2016/0297635 A1 Oct. 13, 2016

(51) Int. Cl.
*B65H 7/12* (2006.01)
*B65H 7/06* (2006.01)
*B65H 5/06* (2006.01)

(52) U.S. Cl.
CPC ..... *B65H 7/125* (2013.01); *B65H 5/062* (2013.01); *B65H 7/06* (2013.01); *B65H 2402/46* (2013.01);
(Continued)

(58) Field of Classification Search
CPC ..... B65H 7/125; B65H 5/062; B65H 7/06; B65H 2513/512; B65H 2515/82;
(Continued)

(56) References Cited

U.S. PATENT DOCUMENTS 6,407,599 B1 * 6/2002 Phinney ..... B65H 7/125 327/151
6,511,064 B1 * 1/2003 Phinney ..... B65H 7/125 271/258.01
(Continued)

FOREIGN PATENT DOCUMENTS

CN 103625953 A 3/2014
JP 57-169767 A 10/1982
(Continued)

OTHER PUBLICATIONS

Office action mailed Dec. 29, 2016 in corresponding Chinese Patent Application No. 201380081845.1, with Eng. trans., 12pp.
(Continued)

*Primary Examiner* — David H Bollinger
(74) *Attorney, Agent, or Firm* — Lewis Roca Rothgerber Christie LLP

(57) ABSTRACT

Provided is a paper transporting device and the like capable of suppressing errors in determining jam occurrences. A paper transporting device has: a transport mechanism; an audio signal output unit that outputs an audio signal according to the sound generated during paper transport; an audio jam determination unit that determines, on the basis of the audio signal, whether a jam has occurred; and a control unit that stops paper transport when the audio jam determination unit determines that a jam has occurred. The control unit controls, in the case of card stock or paperboard being transported by the transport mechanism, so that the audio jam determination unit determines whether a jam has occurred at predetermined times using a determination
(Continued)

method that is different than the method at other times or so that the audio jam determination unit does not determine whether a jam has occurred.

10 Claims, 21 Drawing Sheets

(52) U.S. Cl.
CPC .... *B65H 2404/611* (2013.01); *B65H 2511/13* (2013.01); *B65H 2511/528* (2013.01); *B65H 2513/50* (2013.01); *B65H 2513/512* (2013.01); *B65H 2515/82* (2013.01); *B65H 2701/1311* (2013.01); *B65H 2701/1313* (2013.01)

(58) Field of Classification Search
CPC ..... B65H 2513/50; B65H 2701/1311; B65H 2511/13; B65H 2511/528; B65H 2701/1313; B65H 2404/611; B65H 2402/46; B65H 7/18; B65H 7/20; B65H 2511/20; B65H 2553/30; B65H 2557/112; B65H 2601/255
USPC ..... 271/258.01, 262, 263, 265.01, 265.04
See application file for complete search history.

(56) References Cited

U.S. PATENT DOCUMENTS 6,868,135 B1* 3/2005 Phinney ..... B65H 7/125 324/76.41
2002/0079644 A1* 6/2002 Phinney ..... B65H 7/06 271/258.01
2004/0016797 A1* 1/2004 Jones ..... G07D 7/0026 235/379
2004/0100018 A1* 5/2004 Phinney ..... B65H 7/125 271/262
2004/0145110 A1* 7/2004 Phinney ..... B65H 7/125 271/153
2005/0184453 A1* 8/2005 Sano ..... B65H 7/125 271/262
2012/0019841 A1 1/2012 Schaertel et al.
2012/0235929 A1 9/2012 Hongo et al.
2013/0140760 A1* 6/2013 Syracuse ..... B65H 7/125 271/18
2013/0140766 A1* 6/2013 Syracuse ..... B65H 7/06 271/262
2014/0054841 A1 2/2014 Morikawa et al.
2014/0054844 A1 2/2014 Morikawa et al.
2014/0054850 A1* 2/2014 Umi ..... B65H 5/00 271/264
2014/0054853 A1* 2/2014 Hongo ..... B65H 3/063 271/265.04
2014/0251016 A1* 9/2014 Adams, Jr. ..... B65H 43/04 73/646
2014/0327925 A1* 11/2014 Hongo ..... B65H 7/06 358/1.14
2014/0360275 A1* 12/2014 Link ..... B65H 5/06 73/646
2016/0109843 A1* 4/2016 Link ..... G03G 15/70 399/21

FOREIGN PATENT DOCUMENTS

JP 2001-302021 A 10/2001
JP 2011-31999 A 2/2011
JP 2011-37524 A 2/2011
JP 2012-193040 A 10/2012
JP 5340463 B1 8/2013
JP 5404876 B1 11/2013

OTHER PUBLICATIONS

International Search Report for corresponding International Application No. PCT/JP2013/084875 mailed Mar. 25, 2014, including English translation 5pp.
Written Opinion for corresponding International Application No. PCT/JP2013/084875 mailed Mar. 25, 2014, including English translation 9pp.

* cited by examiner

PAPER CONVEYING APPARATUS, JAM DETECTION METHOD, AND COMPUTER PROGRAM

CROSS-REFERENCE TO RELATED APPLICATION(S)

This application is a National Phase Patent Application and claims priority to and the benefit of International Application Number PCT/JP2013/084875, filed on Dec. 26, 2013, the entire disclosure of which is incorporated herein by reference.

TECHNICAL FIELD

Embodiments discussed in the present specification relate to a paper conveying apparatus, jam determining method, and computer program, more particularly relates to a paper conveying apparatus, jam determining method, and computer program determining whether a jam has occurred based on a sound generated by a paper during conveyance of the paper.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection device of a copier which converts a sound which is generated on a conveyance path to an electrical signal and determines that a jam has occurred when the time during which a reference level is exceeded exceeds a reference value has been disclosed (PLT 1).

CITATION LIST

Patent Literature

PLT 1: Japanese Laid-Open Patent Publication No. 57-169767

SUMMARY

Technical Problem

For example, when a plastic card or thick paper is conveyed, that card or thick paper sometimes strikes the conveyance path generating a loud sound and causing mistaken determining of a jam despite no jam having occurred.

An object of the paper conveying apparatus, jam determining method, and computer program is to suppress mistaken determining of the occurrence of a jam.

Solution Problem

The paper conveying apparatus according to an embodiment includes a conveyor mechanism, a sound signal generator for generating a sound signal corresponding to a sound generated by a paper during conveyance of the paper, a sound jam detector for determining whether a jam has occurred based on the sound signal, and a control module for stopping conveyance of a paper when the sound jam detector determines that a jam has occurred. The control module controls so that the sound jam detector determines whether a jam has occurred at a predetermined timing by a determining method different from a determining method at other timings, or so that the sound jam detector does not determine whether a jam has occurred, when a card or thick paper is conveyed by the conveyance mechanism.

The jam detection method according to an embodiment includes acquiring a sound signal corresponding to a sound which generated by a paper during conveyance of the paper, determining, by a computer, whether a jam has occurred based on the sound signal, and stopping conveyance of a paper when determining that a jam has occurred. The computer controls so that the computer determines whether a jam has occurred at a predetermined timing by a determining method different from a determining method at other timings, or so that the computer does not determine whether a jam has occurred, when a card or thick paper is conveyed by a conveyance mechanism, in the stopping step.

The computer program for a computer according to an embodiment causes the computer to execute a process, the process includes acquiring a sound signal corresponding to a sound generated by a paper during conveyance of the paper, determining whether a jam has occurred based on the sound signal, and stopping conveyance of the paper when determining that a jam has occurred. The computer controls so that the computer determines whether a jam has occurred at a predetermined timing by a determining method different from a determining method at other timings, or so that the computer does not determine whether a jam has occurred, when a card or thick paper is conveyed by a conveyance mechanism, in the stopping step.

Advantageous Effects of Invention

According to the present invention, when a card or thick paper is conveyed by a conveyance mechanism, control is performed so as to determine whether a jam has occurred at a predetermined timing by a determining method different from a determining method at other timings or so as not to determine whether a jam has occurred. Therefore, it becomes possible to suppress mistaken determining of the occurrence of a jam due to the sound generated when a card or thick paper strikes a conveyance path.

The object and advantages of the invention will be realized and attained by means of the elements and combinations particularly pointed out in the claims. It is to be understood that both the foregoing general description and the following detailed description are exemplary and explanatory, and are not restrictive of the invention, as claimed.

DESCRIPTION OF THE EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
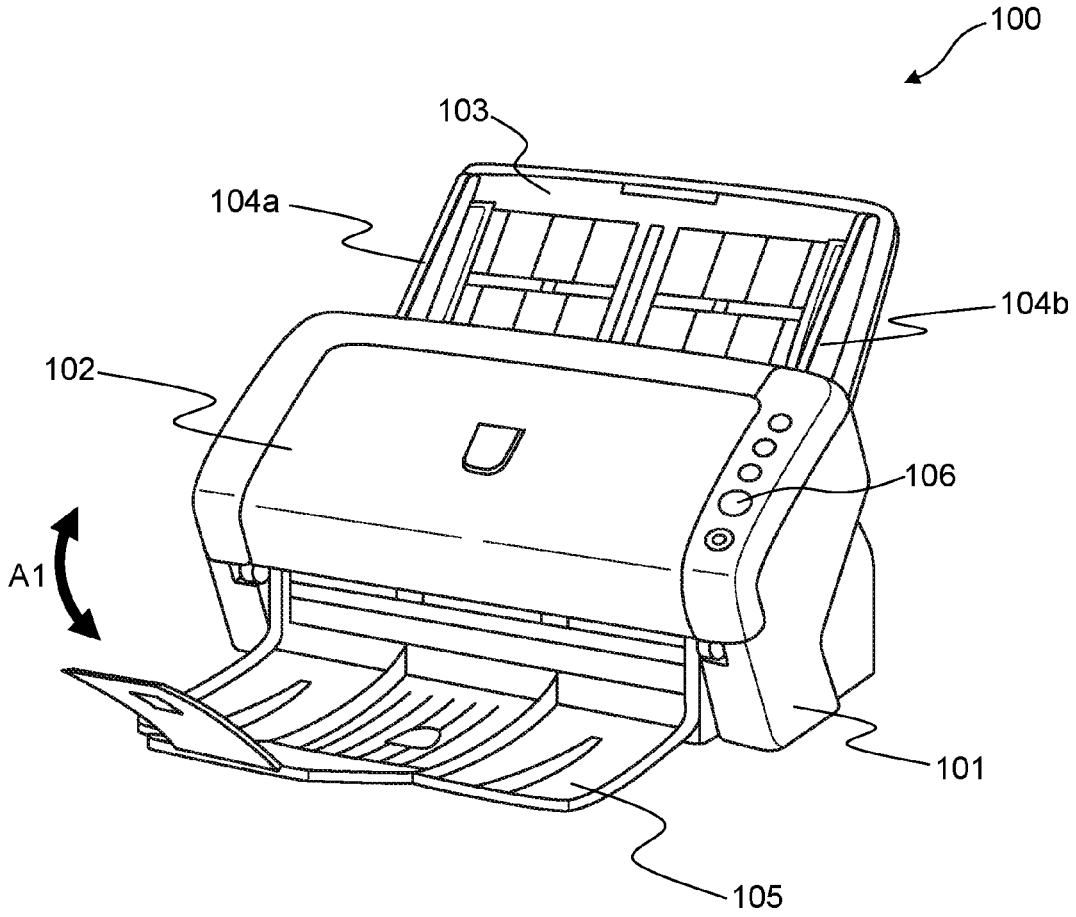
FIG. 1 is a perspective view which shows a paper conveying apparatus 100.

FIG. 1 is an example of a perspective view which shows a paper conveying apparatus 100 which is configured as an image scanner, according to an embodiment.

The paper conveying apparatus 100 includes a lower housing 101, an upper housing 102, a paper tray 103, an ejection tray 105, an operation button 106, etc. in the paper conveying apparatus 100, the conveyed paper is, for example, a document.

The lower housing 101 and the upper housing 102 are formed by plastic material. The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the elected paper can be held.

The operation button 106 is arranged on the surface of the upper housing 102. If pushed, it generates and outputs an operation detection signal.

Figure 2:
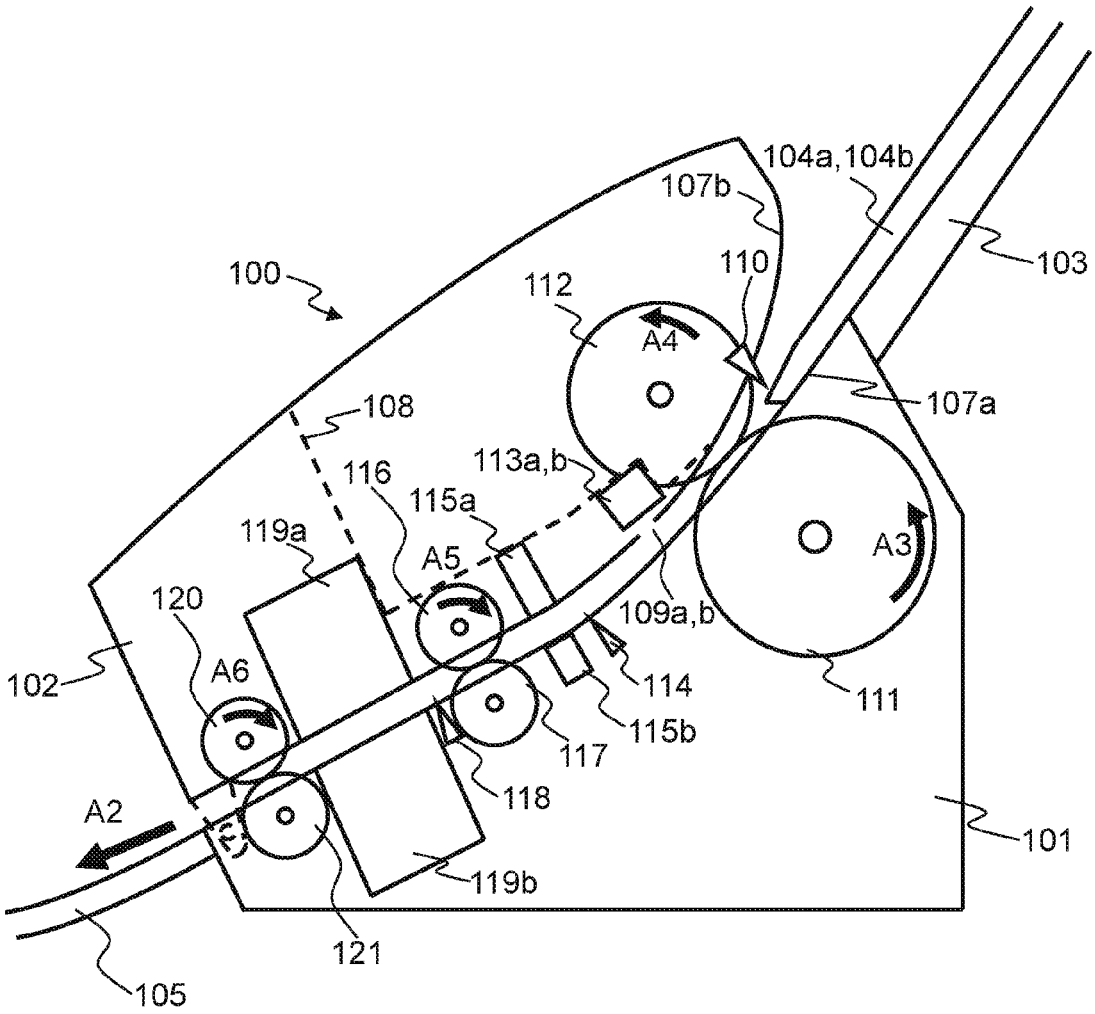
FIG. 2 is a view for explaining a conveyance path at an inside of a paper conveying apparatus 100.

FIG. 2 is an example of a view for explaining the conveyance route at the inside of the paper conveying apparatus 100.

The conveyance route at the inside of the paper conveying apparatus 100 has a first paper detector 110, a paper feed roller 111, a retard roller 112, a first microphone 113*a*, a second microphone 113*b*, a second paper detector 114, an ultrasonic transmitter 115*a*, an ultrasonic receiver 115*b*, a first conveyor roller 116, a first driven roller 117, a third paper detector 118, a first image capture module 119*a*, a second image capture module 119*b*, a second conveyor roller 120, a second driven roller 121, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direct ion of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The first microphone 113*a* and the second microphone 113*b* are respectively provided near the paper conveyance path, detect the sound generated by a paper during conveyance of the paper, and generate analog signals corresponding to the detected sounds. The first microphone 113*a* and the second microphone 113*b* are arranged fastened to an arm 108 inside of the upper housing 102 at the downstream side of the paper feed roller 111 and retard roller 112. The first microphone 113*a* is provided near the side wall of the conveyance path provided at one end in the direction perpendicular to the paper conveyance direction, while the second microphone 113*b* is provided near the side wall of the conveyance path provided at the other end in the direction perpendicular to the paper conveyance direction. To enable the sound generated by a paper during conveyance to be more accurately detected by the first microphone 113*a*, a hole 109*a* is provided at a position of the upper guide 107*b* facing the first microphone 113*a*. Similarly, to enable the sound generated by a paper during conveyance to be more accurately detected by the second microphone 113*b*, a hole 109*b* is provided at a position of the upper guide 107*b* facing the second microphone 113*b*. Below, the first microphone 113*a* and the second microphone 113*b* will sometimes be referred to all together as the "microphones 113".

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there. The second paper detector 114 is an example of a position detection signal generator for detecting a position of the paper and generating a position detection signal. The second paper detection signal is an example of the position detection signal.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture module 119*a* and the second image capture module 119*b* and detects if there is a paper at that position. The third paper detector 118 generates and outputs a third paper detection signal which changes in signal value between a state where there is a paper at that position and a state were there is no such paper there. The third paper detector 114 is an example of a position detection signal generator for detecting a position of the paper and generating a position detection signal. The third paper detection signal is an example of the position detection signal.

The first image capture module 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture module 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture module 119*a* and the second image capture module 119*b* and read only one surface of the paper. Further, instead of a CIS, it is also possible to utilize an image capturing sensor of a reduced magnification optical system type using CCD's (charge coupled devices). Below, the first image capture module 119*a* and the second image capture module 119*b* will sometimes be referred to overall as the "image capture modules 119".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multi-feed). The paper feed roller 111 and the retard roller 112 function as a paper separator.

A paper is fed between the first conveyor roller 116 and the first driven roller 117 while being guided by the lower guide 107*a* and the upper guide 107*b*. The paper is sent between the first image capture module 119*a* and the second image capture module 119*b* by the first conveyor roller 116 rotating in the direction of the arrow mark A5 of FIG. 2. The paper which is read by the image capture module 119 is ejected onto the election tray 105 by the second conveyor roller 120 rotating in the direction of the arrow mark A6 of the FIG. 2.

Figure 3:
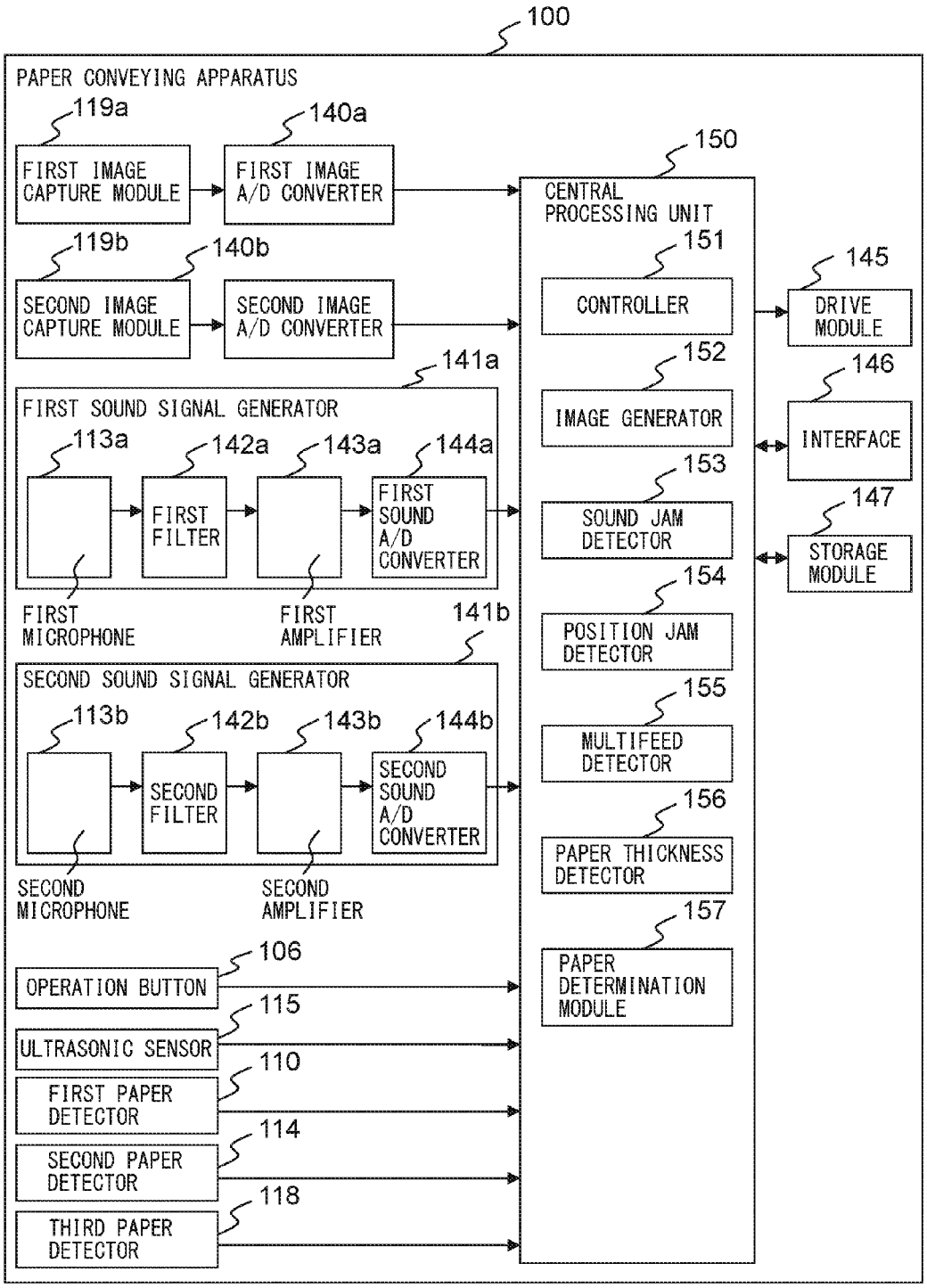
FIG. 3 is a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D converter 140*a*, a second image A/D converter 140*b*, a first sound signal generator 141*a*, a second sound signal generator 141*b*, a drive module 145, an interface 146, a storage module 147, a central processing unit 150, etc.

The first image A/D converter 140*a* converts an analog image signal which is output from the first image capture module 119*a* from an analog to digital format to generate digital image data which it then outputs to the central processing unit 150. Similarly, the second image A/D converter 140*h* converts the analog image signal which is output from the second image capture module 119*b* from an analog to digital format to generate digital image data which it then outputs to the central processing unit 150. Below, these digital image data will be referred to as the "read image".

The first sound signal generator 141*a* includes a first microphone 113*a*, first filter 142*a*, first amplifier 143*a*, first sound A/D converter 144*a*, etc. The first filter 142*a* applies a bandpass filter passing a signal of a predetermined frequency band to an analog signal output from the first microphone 113*a* and outputs it to the first amplifier 143*a*. The first amplifier 143*a* amplifies the signal output from the first filter 142*a* by a predetermined amplification rate and outputs it to the first sound A/D converter 144*a*. The first sound A/D converter 144*a* converts the analog signal output from the first amplifier 143*a* to a digital signal and outputs it to the central processing unit 150. Below, the signal which the first sound signal generator 141*a* generates and outputs will be referred to as the "first sound signal".

Note that, the first sound signal generator 141*a* is not limited to this. The first sound signal generator 141*a* may include only the first microphone 113*a*, and the first filter 142*a*, first amplifier 143*a*, and first sound A/D converter 144*a* may be provided outside of the first sound signal generator 141*a*. Further, the first sound signal generator 141*a* may include only the first microphone 113*a* and first filter 142*a* or may include only the first microphone 113*a*, first filter 142*a*, and first amplifier 143*a*.

The second sound signal generator 141*b* includes a second microphone 113*b*, second filter 142*b*, second amplifier 143*b*, second sound A/D converter 144*h*, etc. The second filter 142*b* applies a bandpass filter passing a signal of a predetermined frequency band to an analog signal output from the second microphone 113*b* and outputs it to the second amplifier 143*b*. The second amplifier 143*b* amplifies the signal output from the second filter 142*b* by a predetermined amplification rate and outputs it to the second sound A/D converter 144*b*. The second sound A/D converter 144*b* outputs an analog signal output from the second amplifier 143*b* to a digital second sound signal and outputs it to the central processing unit 150. Below, the signal which the second sound signal generator 141*b* generates and outputs will be referred to as the "second sound signal".

Note that, the second sound signal generator 141*b* is not limited to this. The second sound signal generator 141*b* may include only the second microphone 113*b*, and the second filter 142*b*, the second amplifier 143*b*, and the second sound A/D converter 144*b* may be provided outside of the second sound signal generator 141*b*. Further, the second sound signal generator 141*b* may include only the second microphone 113*b* and the second filter 142*b* or may include only the second microphone 113*b*, second filter 142*b*, and second amplifier 143*b*.

The drive module 145 includes one or more motors and uses control signals from the central processing unit 150 to rotate the paper feed roller 111, the retard roller 112, the first conveyor roller 116, and the second conveyor roller 120 and operate to convey a paper.

The interface 146 for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 146 so as to store the read image.

The storage module 147 has a RAM (random access memory), ROM (read only memory), or other memory device, a hard disk or other fixed disk device, or flexible disk, optical disk, or other portable storage device. Further, the storage module 147 stores a computer program, database, tables, etc., which are used in various processing of the paper conveying apparatus 100. The computer program may be installed on the storage module 147 from a computer-readable, non-transitory medium such as a compact disk read only memory (CD-ROM), a digital versatile disk read only memory (DVD-ROM), or the like by using a well-known setup program or the like. Furthermore, the storage module 147 stores the read image.

The central processing unit 150 is provided with a CPU (central processing unit) and operates based on a program which is stored in advance in the storage module 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, second paper detector 114, ultrasonic sensor 115, third paper detector 118, first image capture module 119*a*, second image capture module 119*b*, first image A/D converter 140*a*, second image A/D converter 140*h*, sound signal generator 141, drive module 145, interface 146, and storage module 147 and controls these modules.

The central processing unit 150 control a drive operation of the drive module 145, control a paper read operation of the image capture module 119, etc., to acquire a read image. Further, the central processing unit 150 has a control module 151, an image generator 152, a sound jam detector 153, a position jam detector 154, a multifeed detector 155, a paper thickness detector 156, a paper determining module 157, etc. These modules are functional modules which are realized by software which operate on a processor. Note that, these modules may be comprised of respectively independent integrated circuits, a microprocessor, firmware, etc.

Figure 4:
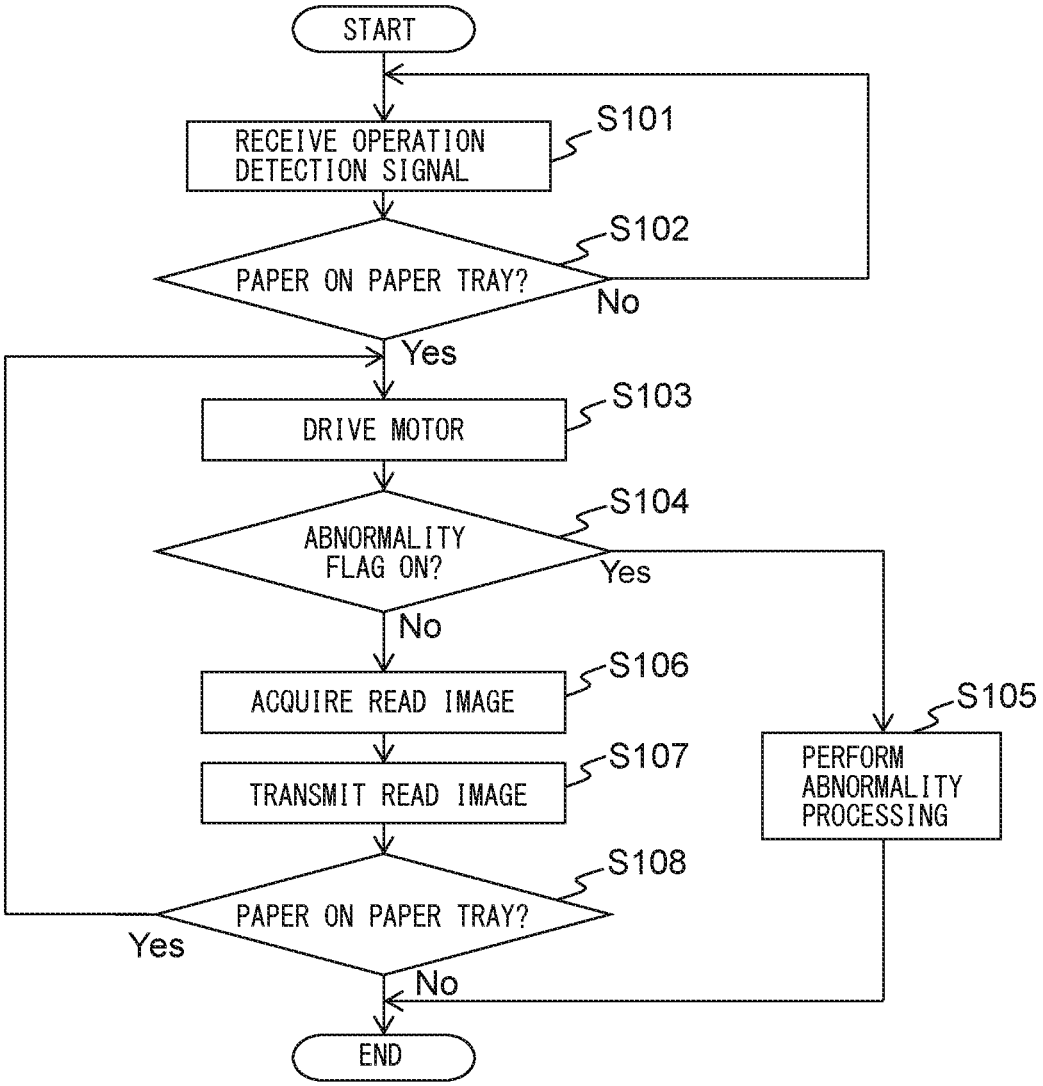
FIG. 4 is a flow chart which shows an example of operation of overall processing of the paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage module 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step 3101 and stands by until newly receiving an operation detection signal from the operation button 106.

On the other hand, when the paper tray 103 has a paper placed on it, the central processing unit 150 drives the drive module 145 to rotate the paper feed roller 111, retard roller 112, first conveyor roller 116, and second conveyor roller 120 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive module 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture module 119*a* and the second image capture module 119*b* read the conveyed paper and acquires the read image through the first image A/D converter 140*a* and the second image A/D converter 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage module 147.

Next, the central processing unit 150 determines whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 5:
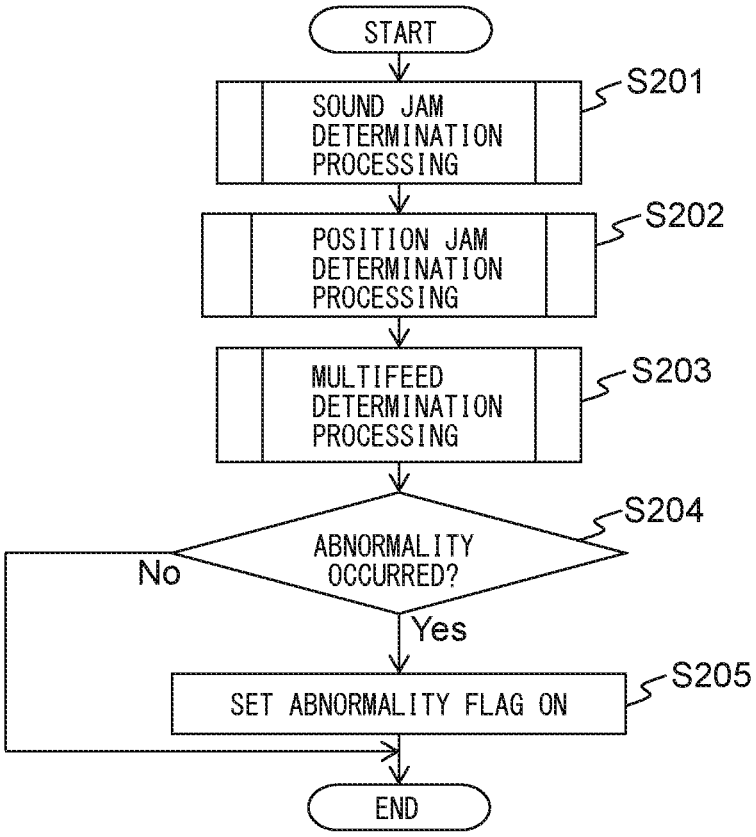
FIG. 5 is a flow chart which shows an example of operation of abnormality determining processing.

FIG. 5 is a flow chart which shows an example of an abnormality detection of the paper conveyance.

The flow of operation which is explained below is executed based on a program which is stored in advance in the storage module 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the first sound signal which was acquired from the first sound signal generator 141*a* and the second sound signal which was acquired from the second sound signal generator 141*b*. Below, sometimes a jam which is determined to exist by the sound jam detector 153 based on a first sound signal and a second sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 115. Details of the multifeed detection processing will be explained later.

Next, the control module 151 determines whether an abnormality has occurred in the paper conveyance processing (step S204). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6A:
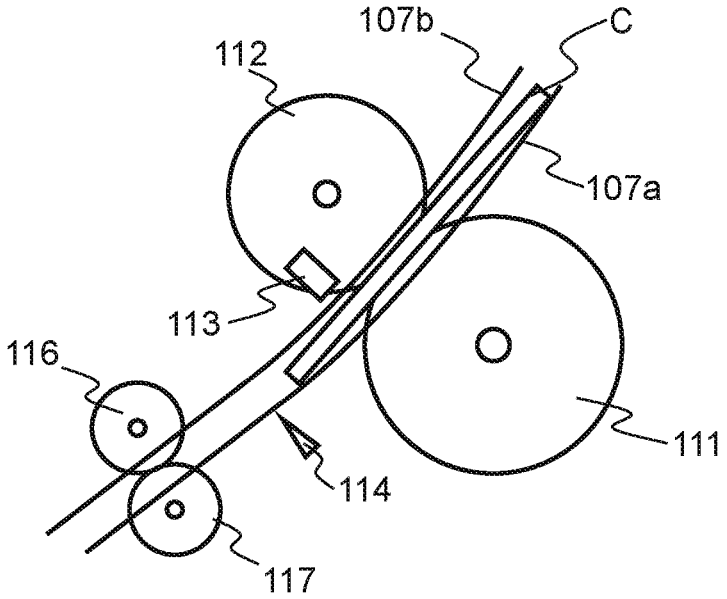
FIG. 6A is a view for explaining a case where a card is conveyed.
Figure 6B:
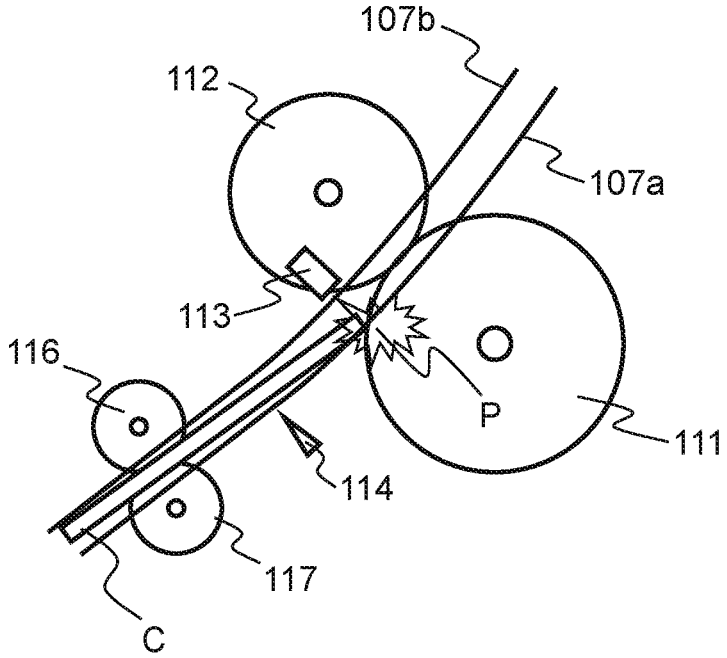
FIG. 6B is a view for explaining a case were a card is conveyed.

FIG. 6A and FIG. 6B are views for explaining the case where a card is conveyed.

FIG. 6A shows the state where a plastic or other high rigidity card C is gripped between the paper feed roller 111 and the retard roller 112. If the card C is further conveyed from the state of FIG. 6A, the state of FIG. 6A shifts to the state of FIG. 6B.

The upper guide 107*b* and the lower guide 107*a* are arranged bent, so if the card C is further gripped by the first conveyor roller 115 and the first driven roller 116 in the state gripped between the paper feed roller 111 and the retard roller 112, it deforms due to its elasticity. For this reason, as shown in FIG. 6B, when the rear end of the card C separates from the paper feed roller 111 and the retard roller 112, the card C tries to return to its original state from the deformed state, so sometimes contacts the lower guide 107*a* at the point P and impact sound is issued. The impact sound which is generated when the card C contacts the lower guide 107*a* ends up being detected by the ultrasonic receiver 114*b*.

The sound jam detector 153 may mistakenly determine that a jam has occurred due to the above impact sound detected at a timing when the back end of the card C passes the paper feed roller 111 and retard roller 112 forming projecting parts of the paper conveyance path. Note that, FIG. 6A and FIG. 6B show examples of conveyance paths at which impact sound is generated when leaving the conveyor roller. The invention is not limited to the same. For example, an impact sound may be generated even at a timing when the back end of the card C passes the first conveyor roller 116 and the first driven roller 117 forming projecting parts of the paper conveyance path or even at a timing when it passes the second conveyor roller 120 and the second driven roller 121. Further, even when the conveyance path is not bent but is flat, differences in height of the rollers may cause impact sound to be generated.

Note that, if the paper feed roller 111, retard roller 112, first conveyor roller 116, first driven roller 117, second conveyor roller 120, or the second driven roller 121 is formed by a plastic material, an impact sound may be generated when the front end of the card C contacts each roller.

Figure 7A:
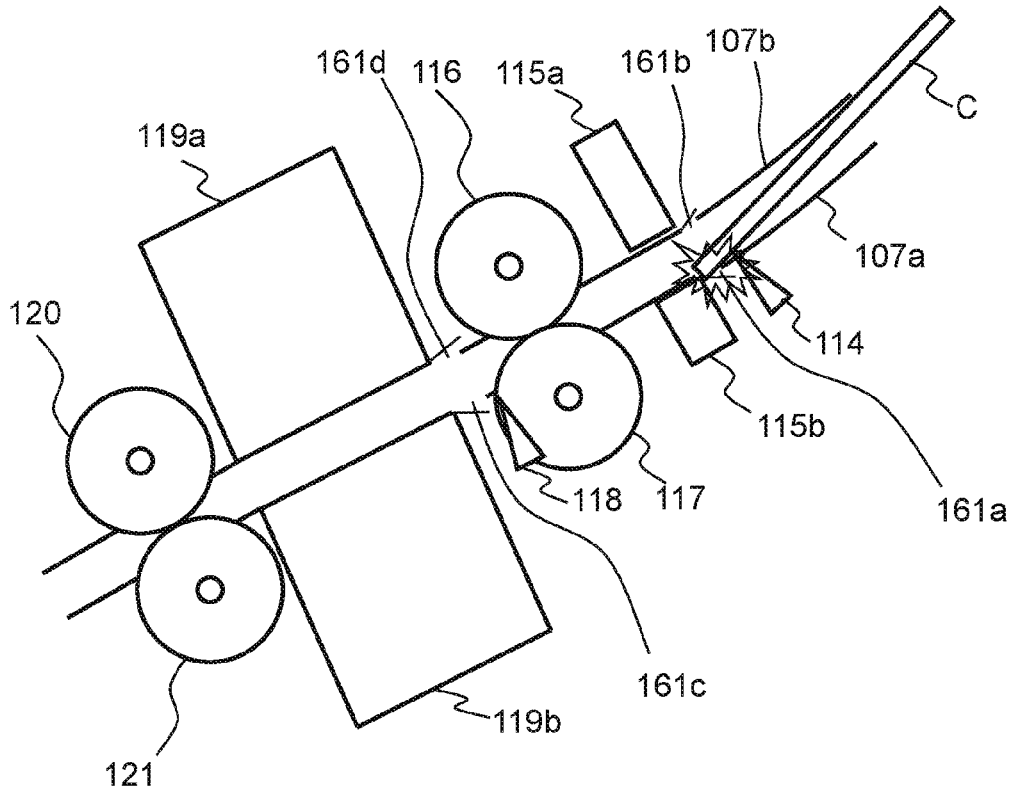
FIG. 7A is a view for explaining another case where a card is conveyed.
Figure 7B:
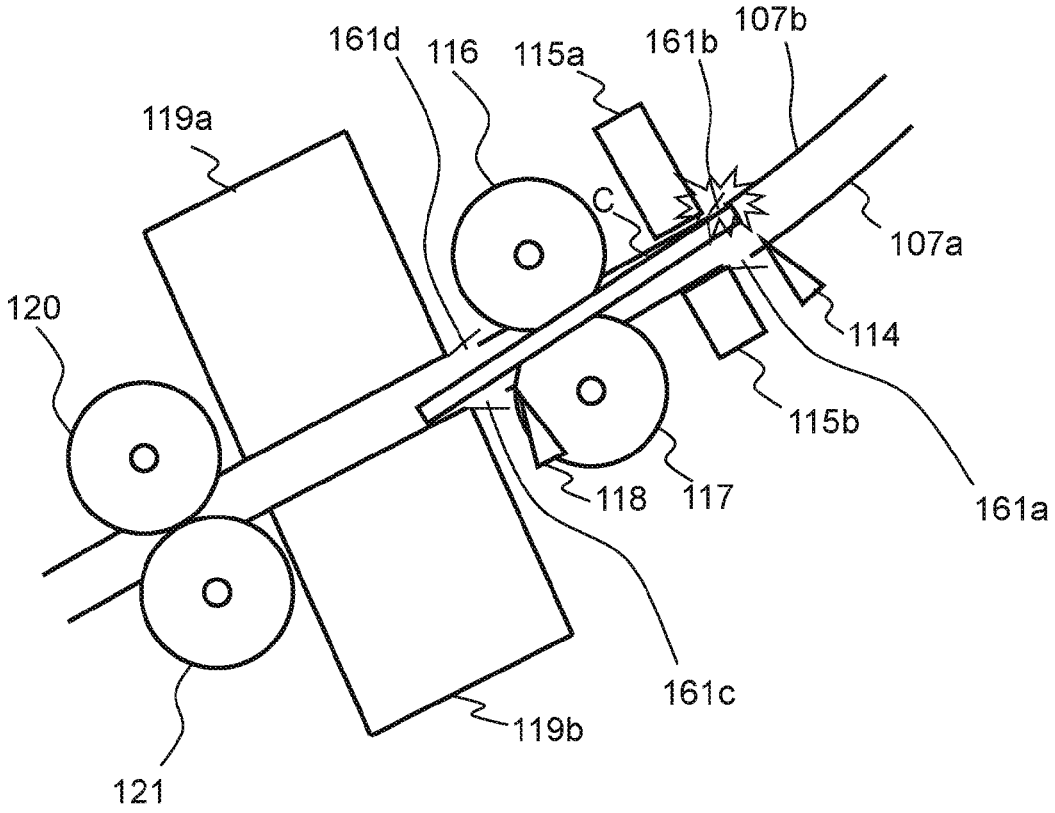
FIG. 7B is a view for explaining another case where a card is conveyed.

FIG. 7A and FIG. 7B are views for explaining another case where a card is conveyed.

As shown in FIG. 7A and FIG. 7B, the lower guide 107*a* and the upper guide 107*b* of the paper conveyance path are respectively formed from pluralities of members. At the joints between the different members, recessed parts 161*a* to 161*d* are formed.

FIG. 7A shows the state where the front end of the card C contacts the recessed part 161*a*. The upper guide 107*b* and the lower guide 107*a* are arranged bent, so sometimes the front end of the card C contacts the recessed part 161*a*. When the front end of a card or thick paper contacts the recessed part 161*a*, it will advance along the recessed part 161*a* as if to push the recessed part 161*a*. The instant it leaves the recessed part 161*a*, it is released all at once and a large sound is sometimes generated. Note that, a large sound may be generated in the same way even at the timing when the front end of the card C leaves the recessed part 161*b*, 161*c*, or 161*d*.

FIG. 7A shows the state where the back end of the card C reaches the recessed part 161*b*. The upper guide 107*b* and the lower guide 107*a* are arranged bent, so the back end of the card C sometimes contacts the recessed part 161*b*. When the back end of the card. C passes the recessed part 161*b*, sometimes it is caught at the recessed part 161*b* and a large sound is generated. Note that, a large sound may be generated in the same way even at the timing when the back end of the card C reaches the recessed part 161*a*, 161*c*, or 161*d*.

Note that the above sound generated when the front end or the back end of the card C passes a relief part of the paper conveyance path can be generated in the same way as a plastic card by other than a plastic card if highly rigid thick paper.

Figure 8:
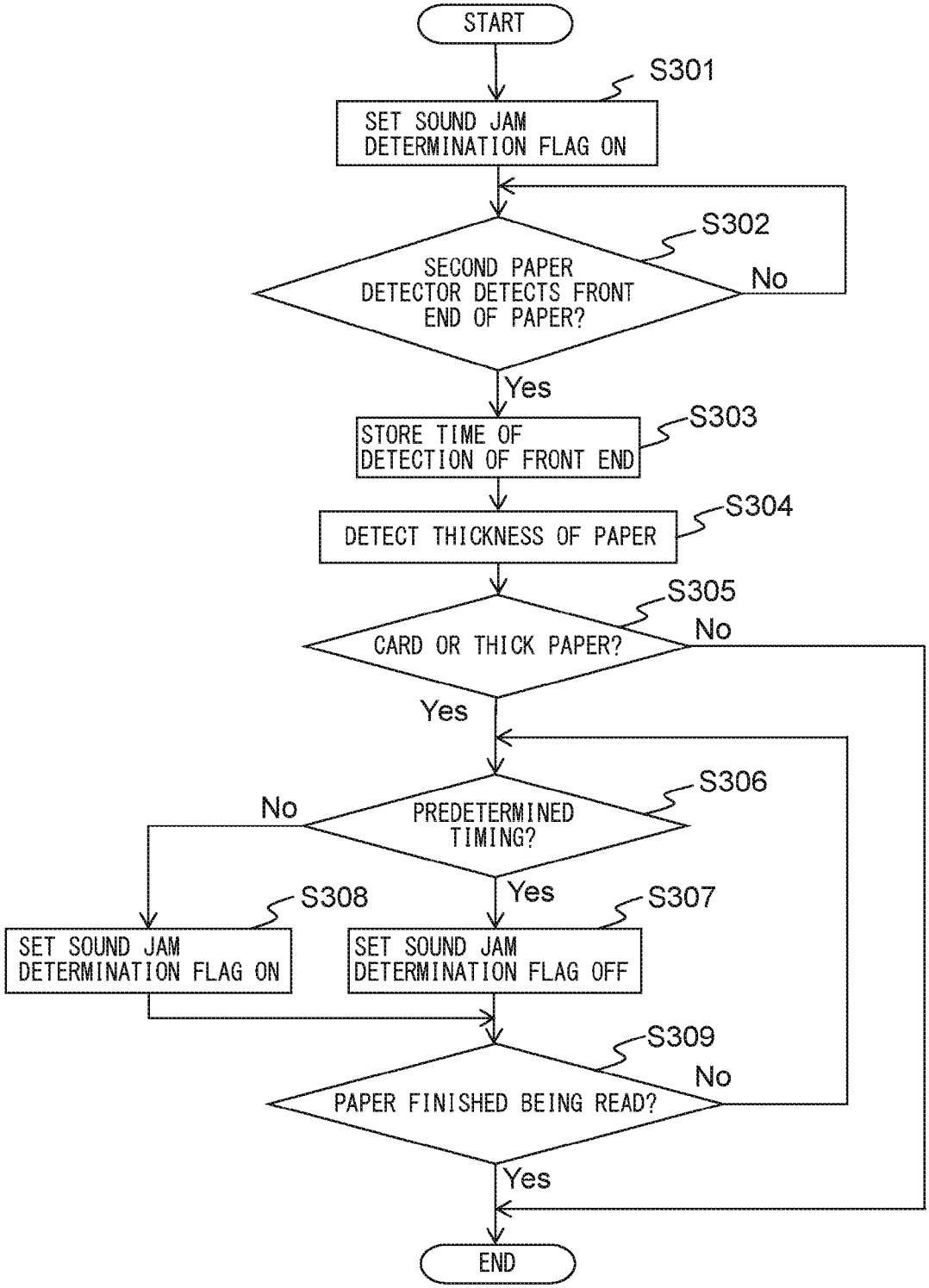
FIG. 8 is a flow chart showing an example of operation of conveyed paper detection processing.

FIG. 8 is a flow chart showing an example of the operation of conveyed paper detection processing.

Below, referring to the flow chart shown in FIG. 8, an example of the operation of conveyed paper detection processing will be explained. Note that, the flow of operation explained below is performed mainly by the central processing unit 150 in cooperation with the different elements of the paper conveying apparatus 100 based on a program stored in advance in the storage module 147. The flow chart shown in FIG. 8 is periodically performed during paper conveyance.

First, the control module 151 sets the sound jam determining flag ON (step S301).

Next, the control module 151 stands by until the second paper detector 114 detects the front end of paper (step S302). The control module 151 determines that the front end of paper has been detected at the position of the second paper detector 114 when the value of the second paper detection signal from the second paper detector 114 changes to a value showing a state where there is no paper to a state where there is a paper.

Next, the control module 151 stores the time when the second paper detector 114 detects the front end of paper as the front end detection time in the storage module 147 (step S303).

Next, the paper thickness detector 156 detects the thickness of the conveyed paper based on the ultrasonic signal output from the ultrasonic sensor 115 (step S304). The paper conveying apparatus 100 stores in the storage module 147 the correspondence, measured by experiments in advance, of the thickness of the conveyed paper and the signal values of ultrasonic signals output from the ultrasonic sensor 115 when that paper is conveyed. The paper thickness detector 156 compares the signal value of the ultrasonic signal output from the ultrasonic sensor 115 with the correspondence relationship stored in the storage module 147 to detect the thickness of the conveyed paper.

Next, the paper determining module 157 determines whether the conveyed paper is a card or thick paper based on the thickness of the paper detected by the paper thickness detector 156 (step S305). The paper determining module 157 determines whether the conveyed paper is a card or thick paper by whether the thickness of the conveyed paper is a predetermined thickness or more. The predetermined thickness is set to a thickness (for example 0.15 mm) enabling a general plastic card (credit card, cash card, telephone card, etc.,) and PPC (plain paper copier) paper to be discriminated.

Next, the control module 151 does not perform any particular processing and ends the series of steps when the conveyed paper is not a card or thick paper. On the other hand, the control module 151 determines whether the current time is a predetermined timing when the conveyed paper is a card or thick paper (step S306). The control module 151 determines that the current time is a predetermined timing when a predetermined time elapses from the front end detection time stored in the storage module 147 at step S303. The predetermined time is determined in advance. The predetermined time includes at least one of the time from when the front end of a card or thick paper of substantially the same size as a credit card, cash card, or other card medium which is conveyed passes the second paper detector 114 until the front end or the back end passes relief parts of the paper conveyance path.

Credit cards, cash cards, and other card media are standardized in size by the JIS (Japanese Industrial Standards) and have long sides of 85.6 cm and short sides of 54.0 cm. Cards of substantially the same size as these card media include train and bus passes, telephone cards, etc., which differ just slightly in size from credit cards, cash cards, etc.

Below, the predetermined time when the relief parts of the paper conveyance path are the paper feed roller 111 and the retard roller 112 will be explained. When a card medium is conveyed in the longitudinal direction, in the period from when the front end passes the second paper detector 114 until the back end passes the nip position of the paper feed roller 111 and the retard roller 112, it moves by exactly a length of the length of the long side minus the distance between the nip position and the second paper detector 114. Therefore, the predetermined time can be made a time having a predetermined duration centered about a value obtained by subtracting from the length of the long side of the card medium the distance between the nip position of the paper feed roller 111 and retard roller 112 and the second paper detector 114 and dividing the result by the conveyance speed. Considering the case where the card medium is conveyed in the short direction, the predetermined time may also include a time having a predetermined duration centered about a value obtained by subtracting from the length of the short side of the card medium the distance between the nip position of the paper feed roller 111 and retard roller 112 and the second paper detector 114 and dividing the result by the conveyance speed. The predetermined duration is set considering the occurrence of error in the timing for detecting the sound signal and can be made, for example, 100 msec in the case of a conveyance speed of 60 ppm.

Note that, the control module 151 may also determine that the current time is the predetermined timing when the current time is a time after the elapse of a predetermined time from the time when the central processing unit 150 drives the drive module 145 to start the rotation of the paper feed roller 111 and retard roller 112. At the point of time when starting the rotation of the paper feed roller 111 and retard roller 112, the front end of the card medium is positioned at the nip position. Therefore, the predetermined time can be made a time having a predetermined duration respectively centered about the value of the length of long side of the card medium divided by the conveyance speed and the value of the short side divided by the conveyance speed.

Alternatively, in the case where a plurality of sheets of paper are conveyed, for the second sheet of paper on, the control module 151 may also determine that the current time is a predetermined timing when the current time is a time after the elapse of a predetermined time from when the back end of paper conveyed immediately before is detected by the second paper detector 114.

Further, the control module 151 may also determine the predetermined timing based on the third paper detection signal from the third paper detector 118 instead of the second paper detection signal from the second paper detector 114.

Alternatively, the control module 151 may also determine the predetermined timing based on an ultrasonic signal from the ultrasonic sensor 115. In this case, the control module 151 periodically acquires an ultrasonic signal from the ultrasonic sensor 115 and determines that the front end of the paper has passes the ultrasonic sensor 115 when the signal value of the acquired ultrasonic signal changes from the predetermined threshold value or more to less than the predetermined threshold value. Further, the sound jam detector 153 determines that the current time is a predetermined timing when the current time is a time after the elapse of a predetermined time from when the front end of paper passes the ultrasonic sensor 115.

Next, the control module 151 sets the sound jam determining flag OFF when the current time is the predetermined timing (step S307) and sets the sound jam determining flag ON when the current time is not the predetermined timing (step S308).

Next, the control module 151 determines whether the image capture module 119 has finished reading the paper (step S309). The control module 151 returns the processing to step S306 and repeats the processing of steps S306 to S308 when the image capture module 119 has not finished reading the paper. On the other hand, the control module 151 ends the series of steps when the image capture module 119 finishes reading the paper.

Note that, when the sound jam determining flag is set OFF, in the later explained sound jam determining processing, the sound jam detector 153 does not determine whether a jam has occurred. Therefore, the control module 151 controls so as to set the sound jam determining flag OFF at a predetermined timing so that the sound jam detector 153 does not determine whether a jam has occurred when a card or thick paper has been conveyed.

Note that, it is also possible to omit the processing of step S305 and have the control module 151 set the sound jam determining flag OFF at a predetermined timing regardless of whether the conveyed paper is a card or thick paper. In this case, even if the conveyed paper is not a card or thick paper, sound jam determining is no longer performed at a predetermined timing, but the sound jam detector 153 can determine whether a jam has occurred based on a sound generated at another timing.

Further, when the control module 151 determines that the conveyed paper is a card or thick paper at step S305, it may proceed to step S307 where it sets the sound jam determining flag OFF. In this case, the control module 151 sets the sound jam determining flag OFF until the next sheet of paper is conveyed, that is, at all timings while a card or thick paper is being conveyed. Due to this, when a card or thick paper is being conveyed, it is possible to more reliably prevent sound from causing mistaken detection of occurrence of a jam.

Figure 9:
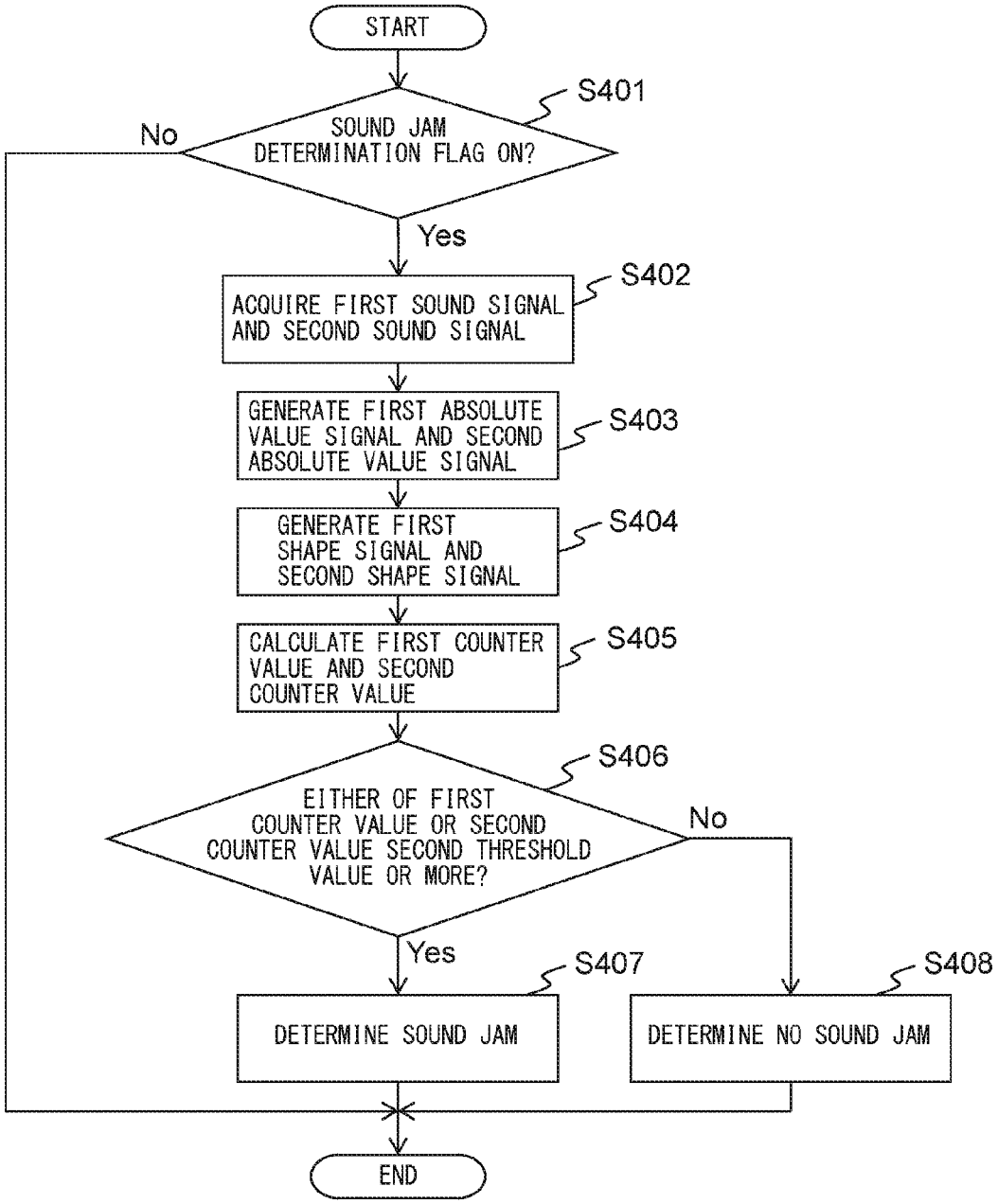
FIG. 9 is a flow chart showing an example of operation of sound jam determining processing.

FIG. 9 is a flow chart which shows an example of operation of a sound jam detection processing.

The flow of operation which is shown in FIG. 9 is executed at step S201 of the flow chart which is shown in FIG. 5.

First, the sound jam detector 153 determines whether the sound jam determining flag is ON (step S401).

When the sound jam determining flag is OFF, the sound jam detector 153 does not perform the sound jam determining but ends the series of steps. On the other hand, when the sound jam determining flag is ON, the sound jam detector 153 acquires the first sound signal from the first sound signal generator 141*a* and acquires the second sound signal from the second sound signal generator 141*b* (step S402).

Figure 10A:
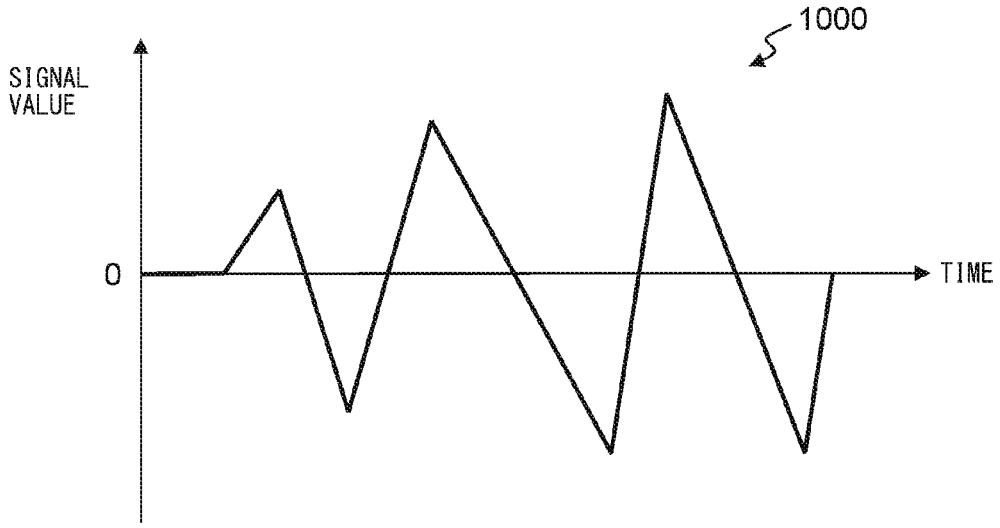
FIG. 10A is a graph showing an example of a sound signal.

FIG. 10A is a graph showing an example of the first sound signal. The graph 1000 shown in FIG. 10A shows the first sound signal acquired from the first sound signal generator 141*a*. In the graph 1000, the abscissa shows the time, while the ordinate shows the signal value.

Next, the sound jam detector 153 generates a first absolute value signal obtaining the absolute value of the first sound signal and a second absolute value signal obtaining the absolute value of the second sound signal (step S403).

Figure 10B:
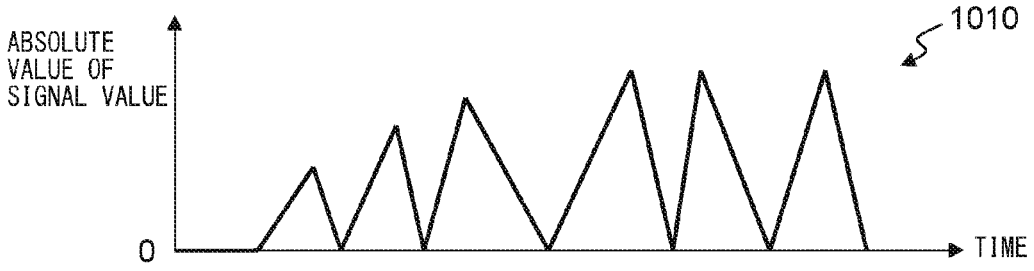
FIG. 10B is a graph showing an example of a signal obtaining the absolute value of a sound signal.

FIG. 10B is a graph showing an example of the first absolute value signal. The graph 1010 shown in FIG. 10B shows the first absolute value signal obtaining the absolute value of the first sound signal of the graph 1000. In the graph 1010, the abscissa shows the time, while the ordinate shows the absolute value of the signal value.

Next, the sound jam detector 153 generates a first shape signal extracting the shape of the first absolute value signal and a second shape signal extracting the shape of the second absolute value signal (step S404). The sound jam detector 153 generates signals obtaining the peak holds of the first absolute value signal and the second absolute value signal as the first shape signal and the second shape signal respectively. The sound jam detector 153 holds the local maximum values of the absolute value signals for exactly a certain hold period then causes them to attenuate by a certain attenuation rate to thereby generate the shape signals.

Figure 10C:
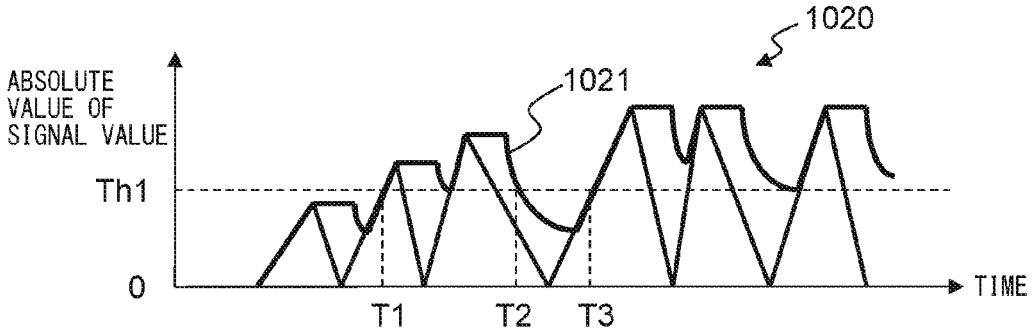
FIG. 10C is a graph showing an example of the shape of a signal obtaining an absolute value of a sound signal.

FIG. 10C is a graph which shows an example of the first shape signal. The graph 1020 shown in FIG. 10C shows the first shape signal 1021 extracting the shape of the first absolute value signal of the graph 1010. In the graph 1020, the abscissa shows the time, while the ordinate shows the absolute value of the signal value.

Next, the sound jam detector 153 calculates a first counter value which is made to increase when the signal value of the first shape signal is the first threshold value Th1 or more and is made to decrease when it is less than the first threshold value Th1. Similarly, the sound jam detector 153 calculates a second counter value which is made to increase when the signal value of the second shape signal is the first threshold value Th1 or more and is made to decrease when it is less than the first threshold value Th1 (step S405).

That is, the first threshold value Th1 is a threshold value for comparing the first sound signal and the second sound signal. The sound jam detector 153 determines whether a jam has occurred based on results of comparison of the values of the first sound signal and the second sound signal, and the first threshold value Th1. Further, the first counter value and the second counter value are variables which are changed according to the values of the first sound signal and the second sound signal. The sound jam detector 153 determines whether a jam has occurred based on the first counter value and the second counter value.

The sound jam detector 153 determines whether the signal value of the first shape signal is the first threshold value Th1 or more every predetermined time interval (for example, sampling interval of sound signal). The sound jam detector 153 increments the first counter value when the signal value of the first shape signal is the first threshold value Th1 or more and decrements the first counter value when it is less than the first threshold value Th1. Similarly, the sound jam detector 153 determines whether the signal value of the second shape signal is the first threshold value Th1 or more every predetermined time interval. The sound jam detector 153 increments the second counter value when the signal value of the second shape signal is the first threshold value Th1 or more and decrements the second counter value when it is less than the first threshold value Th1.

Figure 10D:
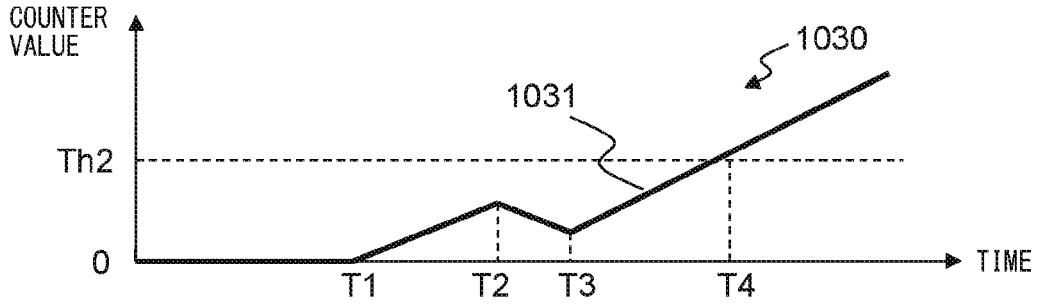
FIG. 10D is a graph which shows an example of a counter value.

FIG. 10D is a graph showing an example of the first counter value. The graph 1030 shown in FIG. 10D shows the first counter value 1031 calculated for the first shape signal 1021 of the graph 1020. In the graph 1020, the abscissa shows the time while the ordinate shows the counter value.

Next, the sound jam detector 153 determines whether at least one of the first counter value or the second counter value is the second threshold value Th2 or more (step S406). The sound jam detector 153 determines that a sound jam has occurred whether at least one of the first counter value or the second counter value is the second threshold value Th2 or more (step S407). On the other hand, the sound jam detector 153 determines that a sound jam has not occurred when both of the first counter value and the second counter value are less than the second threshold value Th2 (step S408) and then ends the series of steps.

That is, the second threshold value Th2 is a threshold value for comparison with the number that the values of the first sound signal and the second sound signal are the first threshold value Th1 or more. The sound jam detector 153 determines whether a jam has occurred based on the results of comparison of the number that the values of the first sound signal and the second sound signal are the first threshold value Th1 or more and the second threshold value Th2.

In FIG. 10C, the first shape signal 1021 becomes the first threshold value Th1 or more at the time T1, becomes less than the first threshold value Th1 at the time 12, again becomes the first threshold value Th1 or more at the time 13, then no longer becomes less than the first threshold value Th1. For this reason, as shown in FIG. 10D, the first counter value 1331 increases from the time T1, decreases from the time T2, again increases from the time T3, and becomes the second threshold value Th2 or more at the time T4, where it is determined that a sound jam has occurred.

Note that, at step S404, the sound jam detector 153 may calculate the signals extracting the envelopes of the first absolute value signal and the second absolute value signal instead of calculating the signals obtaining peak holds over the first absolute value signal and the second absolute value signal as the first shape signal and the second shape signal.

Figure 11A:
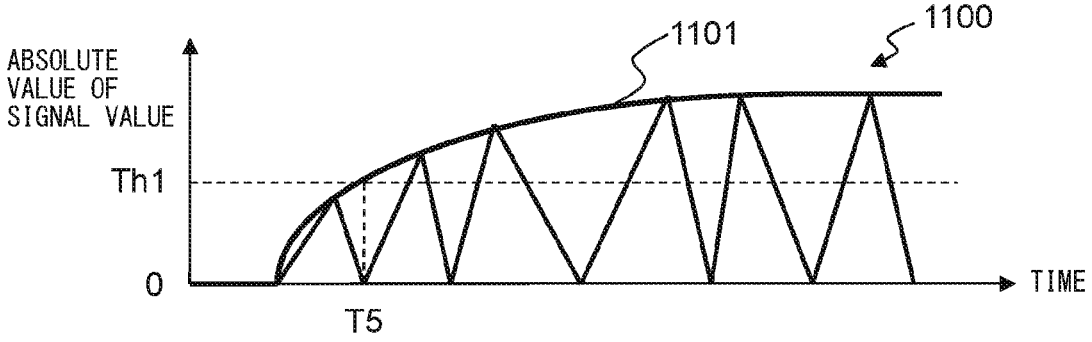
FIG. 11A is a view for explaining processing for determining of occurrence of a jam.

FIG. 11A is a graph showing another example of the first shape signal. The graph 1100 shown in FIG. 11A shows a first shape signal 1101 extracting the envelope from the first absolute value signal of the graph 1010. In the graph 1100, the abscissa shows the time, while the ordinate shows the absolute value of the signal value.

Figure 11B:
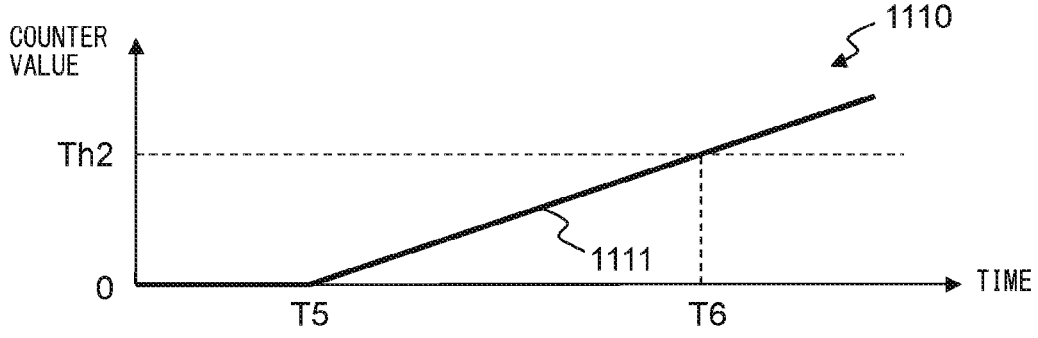
FIG. 11B is a view for explaining processing for determining of occurrence of a jam.

FIG. 11B is a graph showing another example of the first counter value. The graph 1110 shown in FIG. 11B shows the first counter value 1111 calculated for the first shape signal 1101 of the graph 1100. In graph 1110, the abscissa shows the time, while the ordinate shows the counter value. The first shape signal 1101 becomes the first threshold value Th1 or more at the time T5, then does not become less than the first threshold value Th1. Therefore, as shown in FIG. 11B, the counter value increases from the time 15. At the time 16, it becomes the second threshold value Th2 or more whereby the sound jam detector 153 determines that a sound jam has occurred.

Below, the difference between when performing sound jam determining and when not performing sound jam determining, at the timing when the back end of the card passes the separator, will be explained.

Figure 12A:
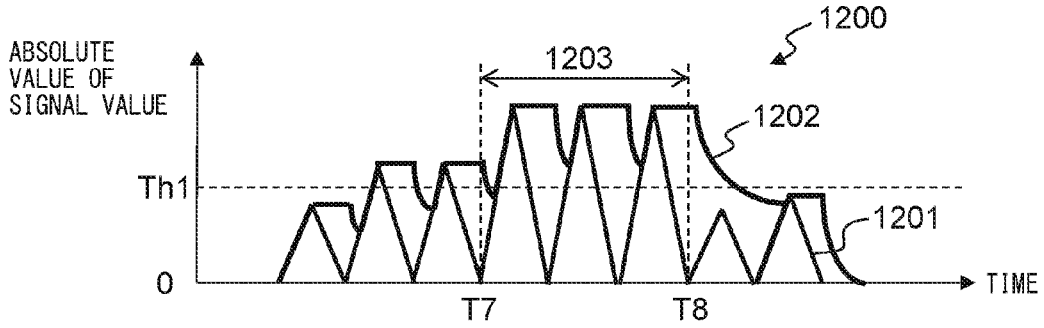
FIG. 12A is a view showing an example of a signal in the case of determining a jam at a predetermined timing.
Figure 12B:
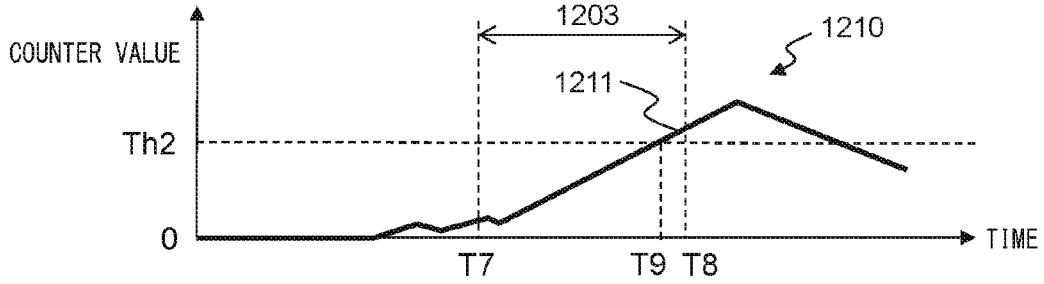
FIG. 12B is a view showing an example of a signal in the case of determining a jam at a predetermined timing.

FIG. 12A and FIG. 12B are graphs showing examples of signals when performing the sound jam determining at the timing when the back end of a card passes the separator.

In FIG. 12A and FIG. 12B, the abscissa shows the time, in FIG. 12A, the ordinate shows the absolute value of the signal value, and, in FIG. 12B, the ordinate shows the counter value. The graph 1200 of FIG. 12A shows the first absolute value signal 1201 and the first shape signal 1202 in the case of performing sound jam determining at the timing at which the back end of the card passes the separator. The section 1203 of the times T7 to T8 shows a section of a predetermined duration while the back end of the card is passing the separator. The graph 1210 of FIG. 12B shows an example of the first counter value 1211 calculated for the first shape signal 1202.

At section 1203, the impact sound generated by the back end of the card causes the first absolute value signal 1201 to become larger and the signal value of the first shape signal 1202 to become the first threshold value Th1 or more. Therefore, at the section 1203, the first counter value 1211 continues to increase. At the time 19, it reaches the second threshold value Th2 or more whereby it is determined that a sound jam has occurred.

Figure 13A:
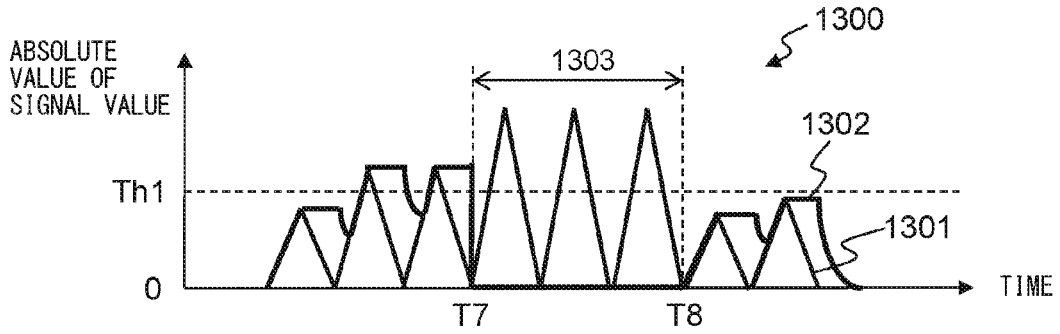
FIG. 13A is a view showing an example of a signal in the case of not determining a jam at a predetermined timing.
Figure 13B:
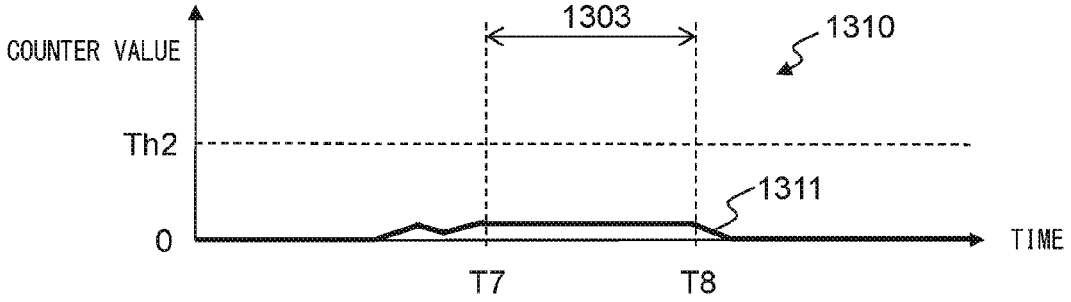
FIG. 13B is a view showing an example of a signal in the case of not determining a jam at a predetermined timing.

FIG. 13A and FIG. 13B are graphs showing examples of signals when not performing the sound jam determining at the timing when the back end of a card passes the separator.

In FIG. 13A and FIG. 13B, the abscissas show the time, in FIG. 13A, the ordinate shows the absolute value of the signal value, and in FIG. 13B, the ordinate shows the counter value. The graph 1300 of FIG. 13A shows the first absolute value signal 1301 and the first shape signal 1302 in the case of not performing sound jam determining at the timing when the back end of the card passes the separator. The section 1303 of the times T7 to 18 shows a section of a predetermined duration while the back end of the card is passing the separator. The graph. 1310 of FIG. 13B shows an example of the first counter value 1311 calculated for the first shape signal 1302.

At the section 1303, due to the impact sound generated by the back end of the card, the first absolute value signal 1301 becomes larger. However, sound jam determining is not performed, so the first counter value 1311 continues to hold the value at the time of the time T7 and does not become the second threshold value Th2 or more, so it is determined that a sound jam has not occurred. Therefore, it is possible to keep the impact sound generated by the back end of the card from causing mistaken determining by sound of occurrence of a jam.

In this way, the control module 151 controls so as to hold the first counter value and the second counter value while the sound jam detector 153 does not determine whether a sound jam has occurred. Note that, the control module 151 may also control so as to reset the first counter value and the second counter value while the sound jam detector 153 is not determining whether a sound jam has occurred. In this case, the sound jam detector 153 resets the first counter value and the second counter value when the sound jam determining flag is OFF at step S401.

Figure 13C:
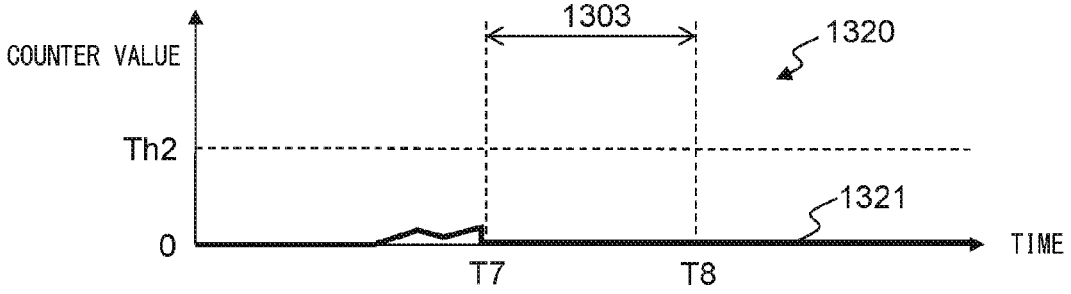
FIG. 13C is a view showing an example of a signal in the case of resetting a first counter value.

FIG. 13C is a graph showing an example of the signal when not performing sound jam determining processing and resetting the first counter value at the time when the back end of the card passes the separator.

In FIG. 13C, the abscissa shows the time, while the ordinate shows the counter value. The graph 1320 of FIG. 13C shows an example of the first counter value 1321 calculated for the first shape signal 1302 of FIG. 13A. The first counter value 1321 is reset at the time T7 at the head of the section 1303. It does not become the second threshold value Th2 or more whereby it is determined that no sound jam occurs.

By holding the counter value while sound jam determining processing is not being performed, it is possible to detect a jam early after passing relief parts if a jam occurs when the front end or the back end of the card or thick paper passes relief parts of the conveyance path. On the other hand, by resetting the counter value while sound jam determining processing is not being performed, it is possible to keep down the effects of any noise etc., generated right before the front end or the back end of the card or thick paper passes relief parts of the conveyance path and suppress mistaken detection of a jam.

Note that, the control module 151 may perform control so that the sound jam detector 153 determines whether a jam has occurred at a timing when the front end or the back end of the card or thick paper passes relief parts of the conveyance path by a determining method different from a determining method at other timings.

For example, the control module 151 changes the first threshold value Th1 between the timing when the front end or the back end of the card or thick paper passes relief parts of the conveyance path and other timings. The control module 151 sets the first threshold value Th1 to a value larger than a value set at other timings instead of setting the sound jam determining flag OFF at step 3307 of FIG. 8. Further, the control module 151 sets the first threshold value Th1 to the original value instead of setting the sound jam determining flag ON at steps 3301 and 3308 of FIG. 8.

Figure 14A:
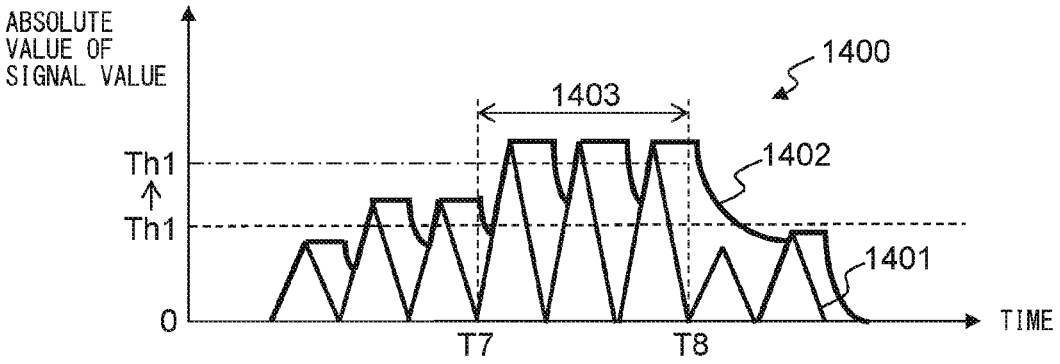
FIG. 14A is a view showing an example of a signal in the case of changing a first threshold value Th1.
Figure 14B:
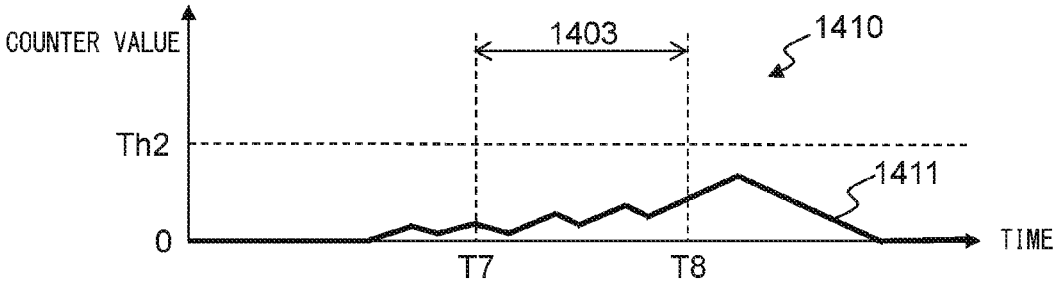
FIG. 14B is a view showing an example of a signal in the case of changing a first threshold value Th1.

FIG. 14A and FIG. 14B are graphs showing examples of signals when setting the first threshold value Th1 to a larger value at the timing when the back end of the card passes the separator than a value at other timings.

In FIG. 14A and FIG. 14B, the abscissas show the time, in FIG. 14A, the ordinate shows the absolute value of the signal value, and in FIG. 14B, the ordinate shows the counter value. The graph 1400 of FIG. 14A shows the first absolute value signal 1401 and the first shape signal 1402. The section 1403 of the times T7 to T8 shows a section of a predetermined duration when the back end of the card passes the separator. The graph 1410 of FIG. 14B shows an example of the first counter value 1411 calculated for the first shape signal 1402.

At the section 1403, the impact sound generated by the back end of the card causes the first absolute value signal 1401 and the first shape signal 1402 to become larger. However, the first threshold value Th1 also becomes larger, so the first counter value 1411 is repeatedly changed (increased or decreased) and will not become the second threshold value Th2 or more so it is determined that a sound jam has not occurred. Therefore, even when the back end of the card passes the separator, it is possible to determine whether a jam has occurred based on the sound while making it harder for it to be determined that a jam has occurred and possible to keep a jam from being mistakenly detected.

Further, the control module 151 can change the second threshold value Th2 between the timing when the front end or the back end of the card or thick paper passes relief parts of the conveyance path and other timings. The control module 151 sets the second threshold value Th2 at a value larger than a value at the other timings instead of setting the sound jam determining flag OFF at step S307 of FIG. 8. Further, the control module 151 sets the second threshold value Th2 to its original value instead of setting the sound jam determining flag ON at steps S301 and S308 of FIG. 8. Note that, the second threshold value Th2 may be made to change every predetermined time interval where it is determined whether the signal values of the first shape signal and the second shape signal are the first threshold value Th1 or more. For example, the control module 151 adds a predetermined value to the second threshold value Th2 every predetermined time interval while the front end or the back end of the card or thick paper is passing relief parts of the conveyance path and after it passes them, subtracts the predetermined value from the second threshold value Th2 every predetermined time interval until becoming the original value. The predetermined value is, for example, 0.5.

Figure 14C:
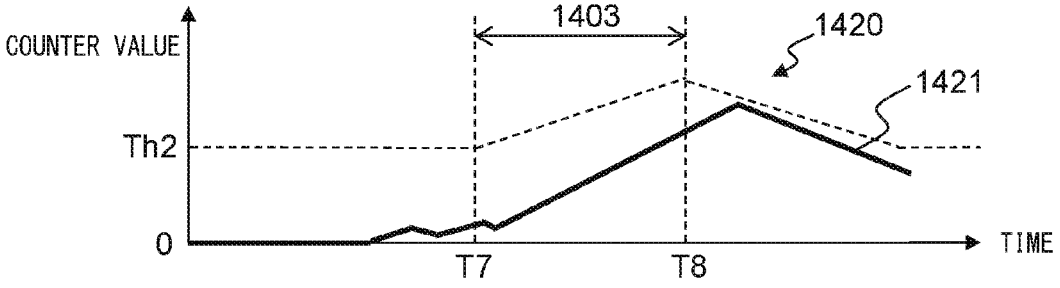
FIG. 14C is a view showing an example of a signal in the case of changing a second threshold value Th2.

FIG. 14C is a graph showing an example of a counter value in the case of setting the second threshold value Th2 to a larger value at the timing when the back end of the card passes the separator than a value at other timings.

In FIG. 14C, the abscissa shows the time, while the ordinate shows the counter value. The graph 1420 of FIG. 14C shows an example of the first counter value 1421 calculated for the first shape signal 1402.

At the section 1403, the impact sound generated by the back end of the card causes the first absolute value signal 1401, the first shape signal 1402, and the first counter value 1421 to become larger. However, the second threshold value Th2 also becomes larger, so the first counter value 1421 does not become the second threshold value Th2 or more and it is determined that a sound jam has not occurred. Therefore, even when the back end of the card passes the separator, it is possible to determine whether a jam has occurred based on the sound while making it harder for it to be determined that a jam has occurred and possible to keep a jam from being mistakenly detected.

Further, the control module 151 may change the ratio of amplification or attenuation of the first sound signal and the second sound signal between the timing when the front end or the back end of the card or thick paper passes relief parts of the conveyance path and other timings. The control module 151 changes the amplification rate by which the first amplifier 143*a* and the second amplifier 143*b* amplify the signal instead of setting the sound jam determining flag OFF at step S307 of FIG. 8. The control module 151 sets the amplification rate at the timing when the front end or the back end of the card or thick paper passes relief parts of the conveyance path at a value smaller than the amplification rates at other timings (for example, to 0.5 time the same). Further, the control module 151 sets the amplification rate to its original value instead of setting the sound jam determining flag ON at steps S301 and S308 of FIG. 8. Note that, the control module 151 may stop the supply of power to the first microphone 113*a* and the second microphone 113*b* and cut the output of the first sound signal and the second sound signal at the timing when the front end or the back end of the card or thick paper is passing relief parts of the conveyance path. Further, the control module 151 may reduce or render zero the values of the digital first sound signal and second sound signal output from the first sound A/D converter 144*a* and the second sound A/D converter 144*b* at the timing when the front end or the back end of the card or thick paper is passing relief parts of the conveyance path.

Figure 15A:
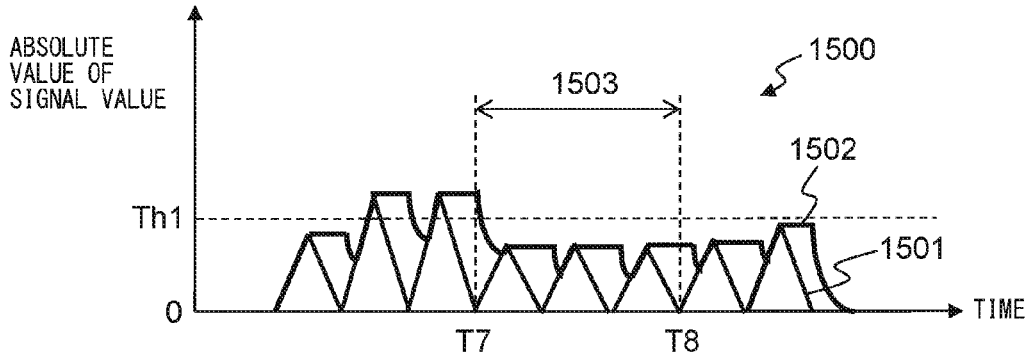
FIG. 15A is a view showing an example of a signal in the case of changing an amplification rate.
Figure 15B:
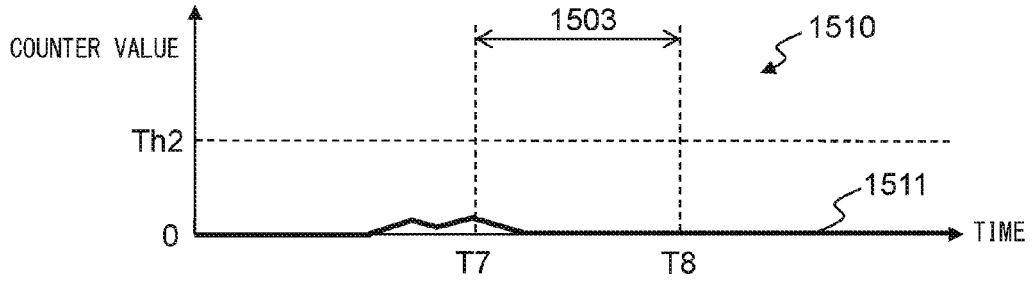
FIG. 15B is a view showing an example of a signal in the case of changing an amplification rate.

FIG. 15A and FIG. 15B are graphs showing examples of signals in the case of setting the amplification rates by the first amplifier 143*a* and the second amplifier 143*b* at the timing when the front end or the back end of the card or thick paper is passing relief parts of the conveyance path to values smaller than the amplification rates at other timings.

In FIG. 15A and FIG. 15B, the abscissas show the time, in FIG. 15A, the ordinate shows the absolute value of the signal value, and in FIG. 15B, the ordinate shows the counter value. The graph 1500 of FIG. 15A shows the first absolute value signal 1501 and the first shape signal 1502. The section 1503 of the times T7 to T8 shows a section of a predetermined duration where the back end of the card passes the separation part. The graph 1510 of FIG. 15B shows an example of the first counter value 1511 calculated for the first shape signal 1502.

At the section 1503, the back end of the card causes a large impact sound to be generated, but the amplification rate by the first amplifier 143*a* is made smaller, so the first absolute value signal 1501 and the first shape signal 1502 do not become large. For this reason, the first counter value 1511 does not become the second threshold value Th2 or more and it is determined that a sound jam has not occurred. Therefore, even when the back end of the card is passing the separator, it is possible to determine whether a jam has occurred based on the sound while making it harder for it to be determined that a jam has occurred and possible to keep a jam from being mistakenly detected.

Figure 16:
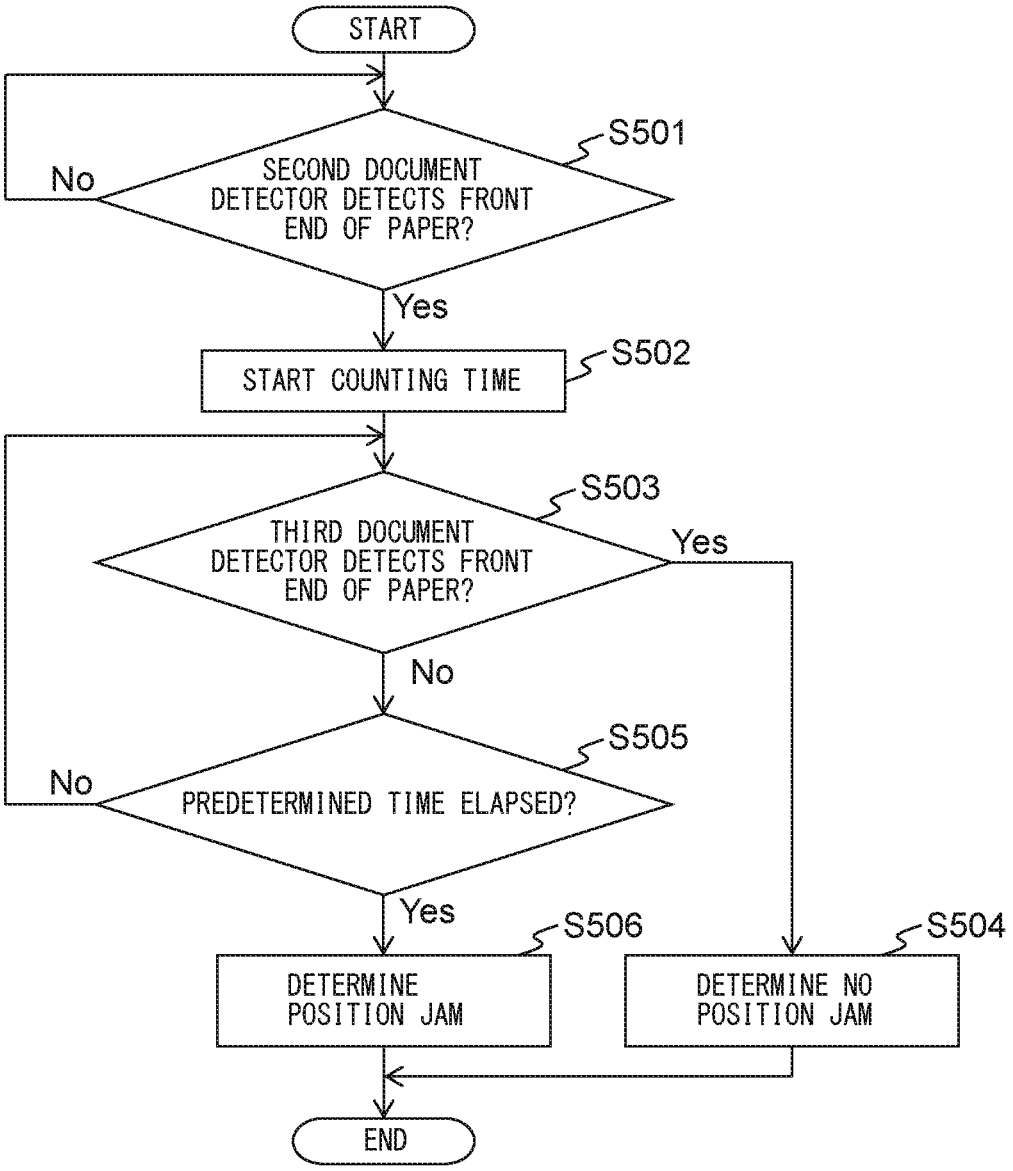
FIG. 16 is a flow chart which shows an example of operation of position jam determining processing.
Figure 17:
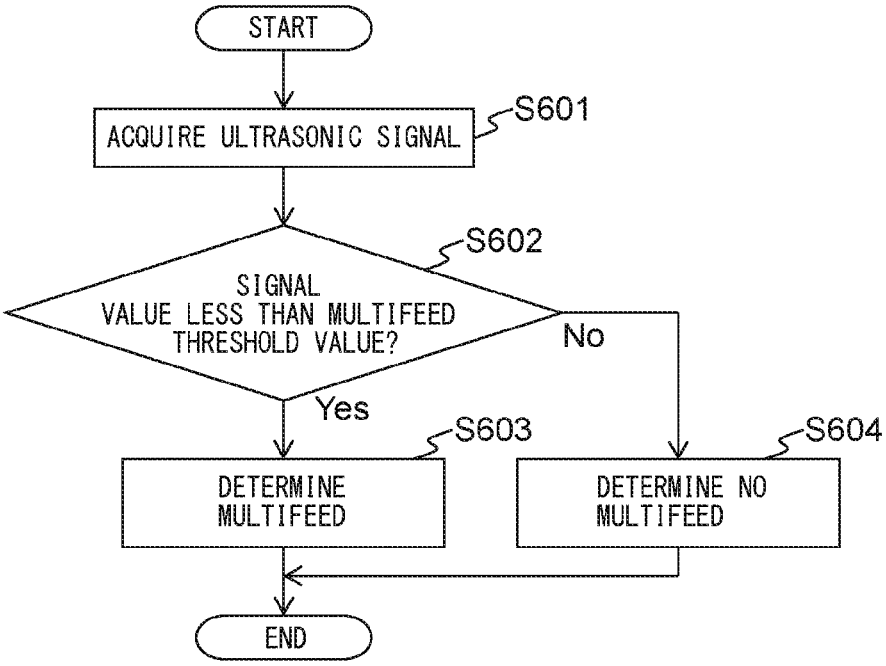
FIG. 17 is a flow chart which shows an example of operation of multifeed determining processing.

FIG. 16 is a flow chart which shows an example of operation of a position jam detection processing.

The flow of operation which is shown in FIG. 16 is executed at step S202 of the flow chart which is shown in FIG. 5.

First, the position jam detector 154 stands by until the front end of the paper is detected by the second paper detector 114 (step S501). The position jam detector 154 determines that the front end of the paper is detected at the position of the second paper detector 114, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S502).

Next, the position jam detector 154 determines whether the third paper detector 118 has detected the front end of the paper (step S503). The position jam detector 154 determines that the front end of the paper is detected at the position of the third paper detector 118, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S504) and ends the series of steps.

On the other hand, if the third paper detector 118 detects the front end of the paper, the position jam detector 154 determines whether a predetermined time (for example, 1 second) has elapsed from the start of counting time (step S505). If a predetermined time has not elapsed, the position jam detector 154 returns to the processing of step S503 and again determines whether the third paper detector 118 has detected the front end of the paper. On the other hand, when a predetermined time has elapsed, the position jam detector 154 determines that position jam has occurred (step S506) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal, it controls the drive module 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal, it again controls the drive module 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive module 145 to rotate the paper feed roller 111 and the retard roller 112 and determine that a position jam has occurred when the third paper detector 118 does not detect the front end of a paper within a predetermined time.

FIG. 11 is a flow chart which shows an example of operation of multifeed detection processing.

The flow of operation which is shown in FIG. 11 is executed at step S203 of the flow chart which is shown in FIG. 5.

First, the multifeed detector 155 acquires an ultrasonic signal from the ultrasonic sensor 115 (step S501).

Next, the multifeed detector 155 determines whether the signal value of the acquired ultrasonic signal is less than the multifeed detection threshold value (step S502).

Figure 18:
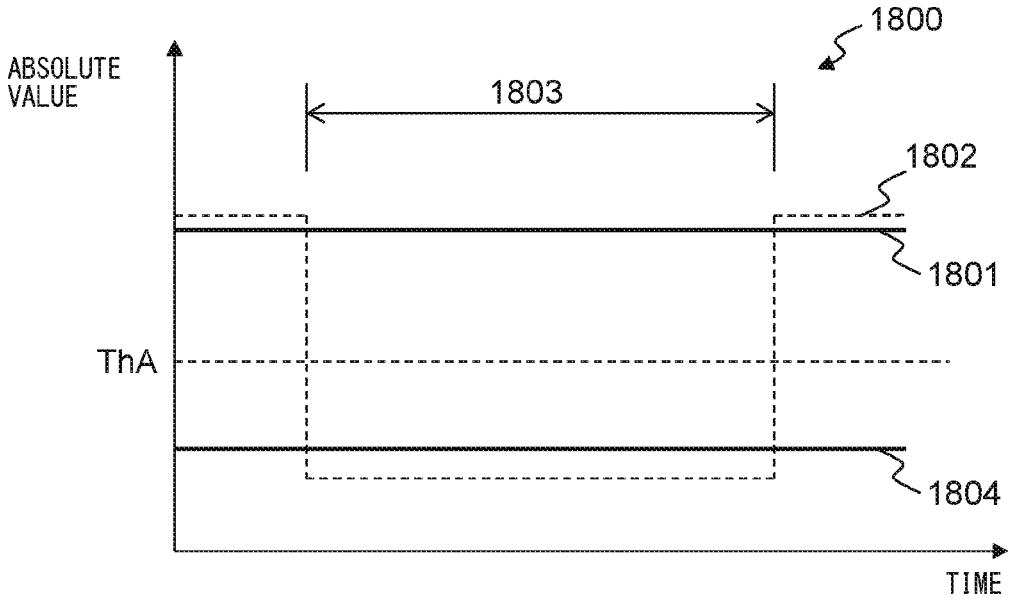
FIG. 18 is a view for explaining properties of an ultrasonic signal.

FIG. 18 is a view for explaining properties of an ultrasonic signal.

In the graph 1800 of FIG. 18, the solid line 1801 shows the characteristic of the ultrasonic signal in the case where a single paper is conveyed, while the broken line 1802 shows the characteristic of the ultrasonic signal in the case where multifeed of papers has occurred. The abscissa of the graph 1800 shows the time, while the ordinate shows the signal value of the ultrasonic signal. Due to the occurrence of multifeed, the signal value of the ultrasonic signal of the broken line 1802 falls in the section 1803. For this reason, it is possible to determine whether multifeed of papers has occurred by whether the signal value of the ultrasonic signal is less than the multifeed detection threshold value ThA.

On the other hand, the solid line 1804 shows the characteristic of an ultrasonic signal in the case where just a single plastic card thicker than paper is being conveyed. When a card is being conveyed, the signal value of the ultrasonic signal becomes smaller than the multifeed determining threshold ThA, so the multifeed determining module 155 mistakenly determines that multifeed of paper has occurred. Note that, even when a sufficiently thick and highly rigid thick paper is conveyed, an ultrasonic signal having similar properties to the case where a plastic card is conveyed is detected, so the multifeed determining module 155 is liable to mistakenly determine that multifeed of paper has occurred.

The multifeed detector 155 determines that multifeed of the papers has occurred when the signal value of the ultrasonic signal is less than the multifeed detection threshold value (step S603), determines that multifeed of the papers has not occurred when the signal value of the ultrasonic signal is the multifeed detection threshold value or more (step S604), and ends the series of steps.

As explained in detail above, the paper conveying apparatus 100 is designed to operate in accordance with the flow charts shown in FIG. 4, FIG. 5, FIG. 8, and FIG. 9 to thereby enable control so as not to determine whether a jam has occurred at a predetermined timing. Alternatively, the paper conveying apparatus 100 is designed to enable control to determine whether a jam has occurred at a predetermined timing by a determining method different from a determining method at other timings. Therefore, it is possible to suppress mistaken determining of occurrence of a jam due to the sound generated when a card or thick paper strikes the conveyance path.

Figure 19:
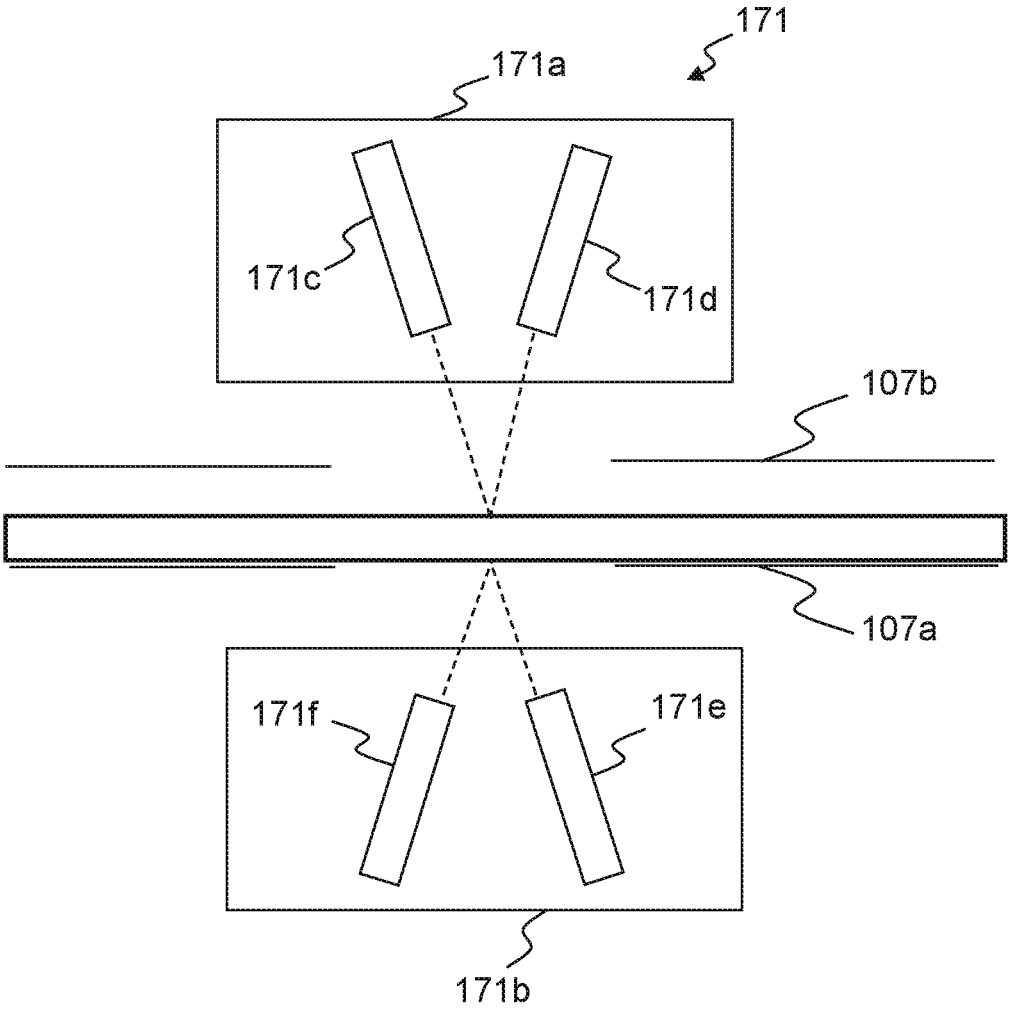
FIG. 19 is a view showing the general configuration of another paper thickness sensor.

FIG. 19 is a view showing the general configuration of another paper thickness sensor 171.

In the example shown in FIG. 19, the paper conveying apparatus 100 further has a paper thickness sensor 171. The paper thickness sensor 171 has two optical type sensors 171*a* and 171*b* arranged straddling the paper conveyance path. The optical type sensor 171*a* is comprised of an LED (light emitting diode) or other light source 171*c* emitting light to the paper being conveyed and a light receiving element 171*d* receiving light emitted from the light source 171*c* and reflected at the paper. The optical type sensor 171*a* measures the distance to the paper based on the light received by the light receiving element 171*d* and generates and outputs an electrical signal corresponding to the distance measured as a distance signal. Similarly, the optical type sensor 171*b* is comprised of an LED or other light source 171*e* emitting light to the paper being conveyed and a light receiving element 171*f* receiving light emitted from the light source 171*e* and reflected at the paper. The optical type sensor 171*b* measures the distance to the paper based on the light received by the light receiving element 171*f* and generates and outputs an electrical signal corresponding to the distance measured as a distance signal. The paper thickness detector 171 detects the thickness of paper from the difference between the distance between the optical type sensors 171*a* and 171*b* and the distances to the paper measured by the optical type sensors 171*a* and 171*b* based on the distance signals received from the two optical type sensors 171*a* and 171*b*.

Figure 20A:
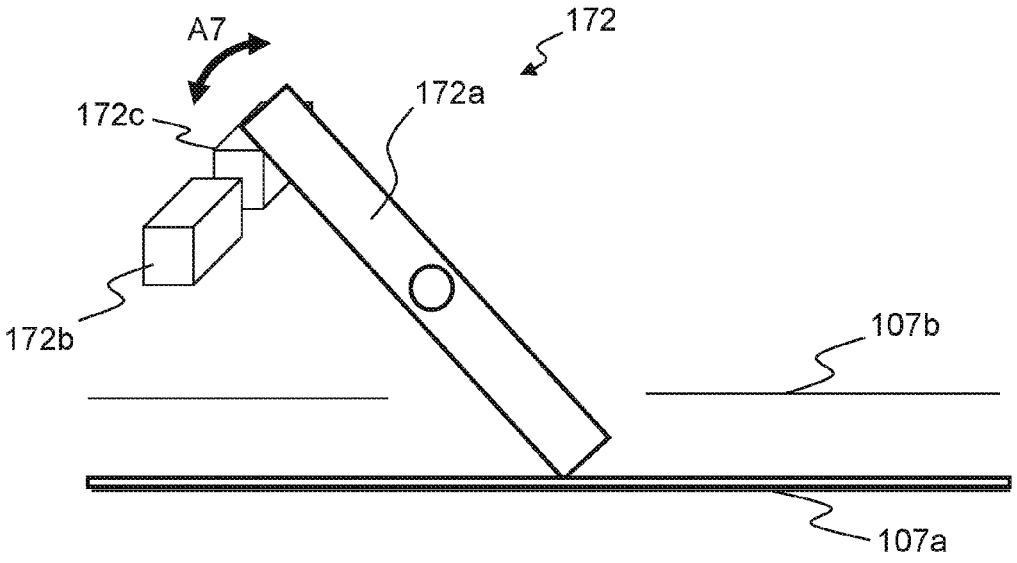
FIG. 20A is a view showing the general configuration of still another paper thickness sensor.
Figure 20B:
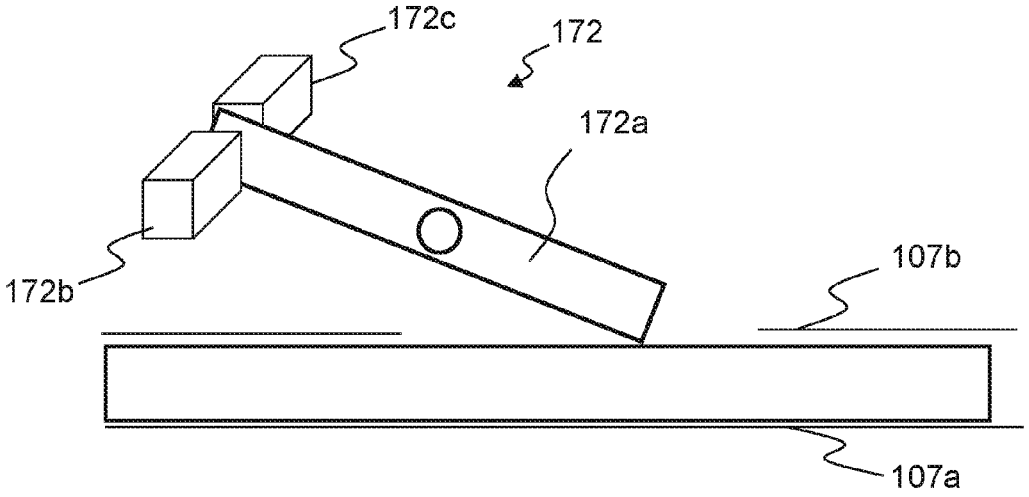
FIG. 20B is a view showing the general configuration of still another paper thickness sensor.

FIG. 20A and FIG. 20B are views showing the general configuration of still another paper thickness sensor 172.

In the example shown in FIG. 20A and FIG. 20B, the paper conveying apparatus 100 further has a paper thickness sensor 172. The paper thickness sensor 172 has an arm 172*a*, light source 172*b*, and light receiving element 172*c*. The arm 172*a* is arranged to contact the conveyed paper and be able to rotate in the direction of the arrow A7 of FIG. 20A in accordance with the thickness of the paper. The light source 172*b* is an LED etc., emitting light to the light receiving element 172*c*. The light receiving element 172*c* receives the light emitted from the light source 172*b* and generates and outputs an electrical signal corresponding to the intensity of the received light as a light intensity signal. As shown in FIG. 20A, if the conveyed paper is thin, the light receiving element 172*c* receives light emitted from the light source 172*b*. On the other hand, as shown in FIG. 20B, if the conveyed paper is thick, the light emitted from the light source 172*b* is blocked by the arm 172*a* tilted due to the paper, so the light receiving element 172*c* does not receive the light emitted from the light source 172*b*. The paper thickness detector 172 determines whether the light receiving element 172*c* has received light emitted from the light source 172*b* based on the light intensity signal received from the light receiving element 172*c* and detects the thickness of the conveyed paper based on that determining result.

Figure 21:
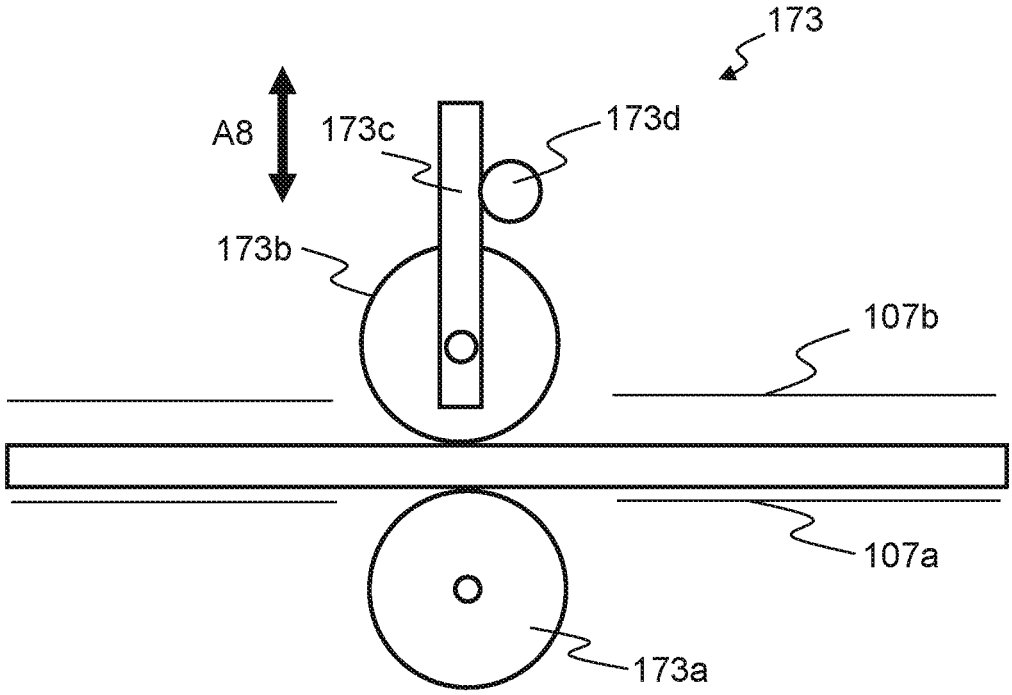
FIG. 21 is a view showing the general configuration of still another paper thickness sensor.

FIG. 21 is a view showing the general configuration of still another paper thickness sensor 173.

In the example shown in FIG. 21, the paper conveying apparatus 100 further has a paper thickness sensor 173. The paper thickness detector 173 has a lower roller 173*a*, upper roller 173*h*, support member 173*c*, rotary encoder 173*d*, etc. The lower roller 173*a* is fastened in place, while the upper roller 173*b* is arranged to be able to be pushed up by the conveyed paper and move in the direction of the arrow A8. The upper roller 173*b* is connected to the support member 173*c*. If the support member 173*c* moves corresponding to movement of the upper roller 173*b*, the rotary encoder 173*d* is configured to rotate. The rotary encoder 173*d* generates and outputs an electrical signal corresponding to the rotational angle as a rotational angle signal. The paper thickness detector 173 detects the distance by which the upper roller 173*b* moves in the upward direction, that is, the thickness of the conveyed paper, based on the rotational angle signal received from the rotary encoder 173*d*.

As explained in detail above, the paper conveying apparatus 100 can use means other than an ultrasonic sensor to detect the thickness of paper.

REFERENCE SIGNS LIST

100. paper conveying apparatus
110. first paper detector
111. paper feed roller
112. retard roller
113. microphone
114. second paper detector
115. ultrasonic sensor
118. third paper detector
119. image capture module
141. sound signal generator
145. drive module
146. interface
147. storage module
150. central processing unit
151. control module
152. image generator
153. sound jam detector
154. position jam determining module
155. multifeed determining module
156. paper thickness detector
157. paper determining module

What is claimed is:

1. A paper conveying apparatus comprising:

a conveyor mechanism;

a sound signal generator for generating a sound signal corresponding to a sound generated by a paper during conveyance of the paper;

a sound jam detector for determining whether a jam has occurred at a predetermined time, based on results of a comparison of a value of the sound signal and a threshold value, wherein the predetermined time is a time period between two positions of the paper during conveyance of the paper; and a control module for stopping conveyance of a paper when the sound jam detector determines that a jam has occurred, wherein the control module changes the threshold value after the predetermined time, when a card or a thick paper is conveyed by the conveyance mechanism.

2. The paper conveying apparatus according to claim 1, further comprising:

a paper thickness detector for detecting a thickness of the paper; and a paper determining module for determining when the conveyed paper is a card or a thick paper, based on the thickness of the paper.

3. The paper conveying apparatus according to claim 1 wherein the control module changes a ratio of amplification or attenuation of the sound signal after the predetermined time.

4. The paper conveying apparatus according to claim 1 wherein the predetermined time is a time at which a front end or a back end of a card or thick paper passes relief parts of a conveyance path.

5. The paper conveying apparatus according to claim 1 wherein the predetermined time is a time period between a front end or a back end of a card or a thick paper that passes relief parts of a conveyance path.

6. A method for determining a jam comprising:

acquiring a sound signal corresponding to a sound generated by a paper during conveyance of the paper;

determining, by a computer, whether a jam has occurred at a predetermined time, based on results of a comparison of a value of the sound signal and a threshold value, wherein the predetermined time is a time period between two positions of the paper during conveyance of the paper; and stopping conveyance of a paper when determining that a jam has occurred, wherein the computer changes the threshold value after the predetermined time, when a card or a thick paper is conveyed by a conveyance mechanism, in the stopping step.

7. A paper conveying apparatus comprising:

a conveyor mechanism;

a sound signal generator for generating a sound signal corresponding to a sound generated by a paper during conveyance of the paper;

a sound jam detector for determining whether a jam has occurred at a predetermined time, based on results of a comparison of a number of times that a value of the sound signal is equal to or more than a first threshold value or more and a second threshold value, wherein the predetermined time is a time period between two positions of the paper during conveyance of the paper; and a control module for stopping conveyance of a paper when the sound jam detector determines that a jam has occurred, wherein the control module changes the second threshold value after the predetermined time, when a card or a thick paper is conveyed by the conveyance mechanism.

8. The paper conveying apparatus according to claim 7, further comprising:

a paper thickness detector for detecting a thickness of the paper; and a paper determining module for determining when the paper is a card or a thick paper, based on the thickness of the paper.

9. The paper conveying apparatus according to claim 7 wherein the control module changes a ratio of amplification or attenuation of the sound signal after the predetermined time.

10. A method for determining a jam comprising:

acquiring a sound signal corresponding to a sound which is generated by a paper during conveyance of the paper;

determining whether a jam has occurred at a predetermined time, based on results of a comparison of a number of times that a value of the sound signal is equal to or more than a first threshold value or more and a second threshold value, wherein the predetermined time is a time period between two positions of the paper during conveyance of the paper; and stopping conveyance of a paper when determining that a jam has occurred, wherein the computer changes the second threshold value after the predetermined time, when a card or a thick paper is conveyed by the conveyance mechanism.

* * * * *